US008929756B2

(12) United States Patent
Nakagawa

(10) Patent No.: US 8,929,756 B2
(45) Date of Patent: Jan. 6, 2015

(54) DEVELOPING DEVICE, IMAGE FORMING APPARATUS, AND METHOD FOR CHANGING DUTY RATIO

(71) Applicant: KYOCERA Document Solutions Inc., Osaka (JP)

(72) Inventor: Tatsuya Nakagawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 84 days.

(21) Appl. No.: 13/861,682

(22) Filed: Apr. 12, 2013

(65) Prior Publication Data

US 2013/0287415 A1 Oct. 31, 2013

(30) Foreign Application Priority Data

Apr. 25, 2012 (JP) ..... 2012-100067

(51) Int. Cl.
*G03G 15/00* (2006.01)
*G03G 15/06* (2006.01)
*G03G 15/09* (2006.01)

(52) U.S. Cl.
CPC ..... *G03G 15/065* (2013.01)
USPC ..... 399/44; 399/55; 399/270

(58) Field of Classification Search
USPC ..... 399/44, 55, 270
See application file for complete search history.

(56) References Cited

U.S. PATENT DOCUMENTS 4,872,100 A * 10/1989 Diaz ..... 363/41
5,819,131 A * 10/1998 Kim ..... 399/44
6,128,449 A * 10/2000 Zenba et al. ..... 399/50
6,282,385 B1 * 8/2001 Suto ..... 399/55
7,113,737 B2 * 9/2006 Morihara ..... 399/328
2006/0072931 A1 * 4/2006 Asakura et al. ..... 399/33
2006/0275062 A1 * 12/2006 Morihara ..... 399/328
2007/0086797 A1 * 4/2007 Watanabe ..... 399/27
2007/0223946 A1 * 9/2007 Watanabe ..... 399/27
2008/0181642 A1 * 7/2008 Kishi ..... 399/69
2008/0232862 A1 * 9/2008 Fujishima et al. ..... 399/285
2009/0028593 A1 * 1/2009 Okumura ..... 399/55
2010/0129102 A1 * 5/2010 Fujihara et al. ..... 399/55
2010/0135698 A1 * 6/2010 Nemoto ..... 399/168
2010/0290795 A1 * 11/2010 Seki et al. ..... 399/30
2010/0303488 A1 * 12/2010 Yanagi ..... 399/45
2011/0150522 A1 * 6/2011 Hayasaki et al. ..... 399/88

(Continued)

FOREIGN PATENT DOCUMENTS

JP 08044226 A * 2/1996 ..... G03G 15/20
JP 2006074967 A * 3/2006
JP 2006-221107 A 8/2006
JP 2007322727 A * 12/2007

*Primary Examiner* — David Bolduc

(74) *Attorney, Agent, or Firm* — Knobbe, Martens, Olson & Bear LLP

(57) ABSTRACT

A developing device includes a developing roller, a magnetic roller, a capacitor, a transformer, a switching section, a control section, a temperature detecting section, and a storage section. When changing the duty ratio of a control signal in multiple sequential steps, the control section determines the resonance period based on the temperature and temperature characteristic data and changes the duty ratio of the control signal to the next step during a changing time slot which is one of the first and second halves of a period of voltage fluctuation of the capacitor based on the determined resonance period, the one half in which the current flowing through the switching section is smaller than in the other half of the period.

12 Claims, 15 Drawing Sheets

(56) References Cited

U.S. PATENT DOCUMENTS

| | | | | |
|---|---|---|---|---|
| 2011/0211292 | A1* | 9/2011 | Tyler | 361/225 |
| 2011/0222889 | A1* | 9/2011 | Tabuchi | 399/69 |
| 2011/0293300 | A1* | 12/2011 | Tanaka | 399/43 |
| 2011/0293313 | A1* | 12/2011 | Samejima | 399/88 |
| 2012/0020705 | A1* | 1/2012 | Yamamoto | 399/266 |
| 2012/0063799 | A1* | 3/2012 | Ueno | 399/67 |
| 2012/0070177 | A1* | 3/2012 | Okumura | 399/88 |
| 2012/0134705 | A1* | 5/2012 | Fukutani | 399/88 |
| 2012/0301159 | A1* | 11/2012 | Takahashi | 399/27 |
| 2013/0156454 | A1* | 6/2013 | Fujihara et al. | 399/55 |
| 2013/0183053 | A1* | 7/2013 | Nakagawa et al. | 399/55 |
| 2013/0259504 | A1* | 10/2013 | Fujihara | 399/55 |
| 2013/0330094 | A1* | 12/2013 | Tanaka | 399/44 |

* cited by examiner

Fig. 11

| TEMPERATURE CHARACTERISTIC DATA | | |
|---|---|---|
| Period $=2\pi\sqrt{LC}$ | | Resonance Frequency$=\frac{1}{2\pi\sqrt{LC}}$ |
| Temperature (°C) | Capacitance | Inductance |
| T1 | C1 | L1 |
| T2 | C2 | L2 |
| … | … | … |
| Tx | Cx | Lx |

Fig. 12

| TEMPERATURE CHARACTERISTIC DATA | |
|---|---|
| Temperature (°C) | Period |
| T3 | P3 |
| T4 | P4 |
| … | … |
| Ty | Py |

Fig. 15

| TEMPERATURE CHARACTERISTIC DATA | | | |
|---|---|---|---|
| Resonance Period$=2\pi\sqrt{LC}$ | | Resonance Frequency$=\frac{1}{2\pi\sqrt{LC}}$ | |
| Temperature (°C) | Capacitance | Temperature (°C) | Inductance |
| T5 | C5 | T7 | L7 |
| T6 | C6 | T8 | L8 |
| … | … | … | … |
| Tz | Cz | Tw | Lz |

DEVELOPING DEVICE, IMAGE FORMING APPARATUS, AND METHOD FOR CHANGING DUTY RATIO

INCORPORATION BY REFERENCE

This application claims priority to Japanese Patent Application No. 2012-100067 filed on Apr. 25, 2012, the entire contents of which are incorporated by reference herein.

BACKGROUND

The present disclosure relates to a developing device configured to develop an electrostatic latent image using toner and relates to an image forming apparatus including the developing device.

Some image forming apparatuses, including multifunction peripherals, copiers, printers, and facsimile machines, perform printing by using toner to develop an electrostatic latent image formed on a photosensitive drum. In some of these image forming apparatuses, a developer (so-called two-component developer) containing a magnetic carrier and a toner is used. However, if, in the case of development using a two-component developer, a magnetic brush using the magnetic carrier is brought into direct contact with the photosensitive drum, various undesirable effects, such as poor image quality, will be produced. For this reason, there is proposed an image forming apparatus including a developing device of a development system (referred to also as a "touchdown development" or a "hybrid development") in which an electrostatic latent image is developed without contact of a magnetic brush with a photosensitive drum by placing a developing roller for carrying toner to face the photosensitive drum, forming the magnetic brush on a magnetic roller placed to face the developing roller, and transferring only the toner to the developing roller using the magnetic brush. This development system is more advantageous than the one-component development system and the conventional two-component development system in various aspects, such as image quality, print speed, toner life, and anti-scattering of carrier.

There is also proposed an image forming apparatus configured to form an image on a paper sheet by using a developing roller capable of formation of a thin toner layer on the surface thereof and a magnetic roller capable of supplying toner to the developing roller by means of a magnetic carrier and developing an electrostatic latent image with the developing roller, wherein, without provision of any additional special member, a high-speed, small-sized, hybrid developing device advantageous in various aspects, such as image quality, toner life, anti-scattering of carrier, and print speed, is achieved.

In the above touchdown development system, an AC voltage (for example, about 1 to 2 kV from peak to peak) is applied to the developing roller to cause charged toner to fly toward and deposit on the photosensitive drum and thereby develop an electrostatic latent image. In some developing devices of this system, a signal representing ON/OFF of energization is generated by switching, a signal obtained by removing a DC component from the above ON/OFF signal using a capacitor is input to the primary side of a transformer, and an AC voltage to be applied to the developing roller is acquired from the secondary side of the transformer.

In this case, from the viewpoint of prevention of leakage (discharge) between the photosensitive drum and the developing roller and prevention of production of an uneven toner image, it may be desired to change the duty ratio for the switching. However, a change of the duty ratio for the switching results in the application of an unbalanced voltage (energy-biased voltage) to the transformer and so on. Therefore, the transformer may produce magnetic bias or magnetic saturation. If magnetic bias or magnetic saturation is produced to bias the magnetic flux, the transformer will be biased by a direct current, so that a large current (an eddy current) will be very likely to flow. In addition, if a large current over the rated current flows through the switching element, the switching element will be broken down. Furthermore, as the amount of duty ratio instantaneously changed is larger, a larger magnetic bias will be produced and a large current will be more likely to flow through the switching element.

To cope with this, it can be considered to change the duty ratio stepwise multiple times until a desired duty ratio is reached. In this case, whenever the duty ratio is changed, energy resonance (oscillation) between the transformer and the capacitor occurs to produce periodic fluctuation in voltage between the electrodes of the capacitor (and also on the transformer side thereof). In relation to this energy oscillation, the period of the fluctuation in voltage between the electrodes of the capacitor may include a timing (time slot) in which a large current is particularly likely to flow through the switching element. Therefore, a problem arises in that even if the duty ratio is changed stepwise, it is necessary to avoid a large current flowing though the switching element.

Furthermore, the period of fluctuation in voltage between the electrodes of the capacitor has a relationship with the period (or frequency) of resonance between the capacitor and the transformer. The resonance period (or resonance frequency) depends upon the capacitance of the capacitor and the inductance value of the transformer (the primary coil thereof). The capacitance and the inductance value depend upon temperature. Therefore, the time slot in which a large current is likely to flow through the switching element during the period of fluctuation in voltage between the electrodes of the capacitor also depends upon temperature. Hence, another problem arises in that if the timing at which the duty ratio is changed is fixed (constant), it is not possible to surely avoid a large current flowing through the switching element.

The above image forming apparatus achieving a small-sized, hybrid developing device does not take into account the likelihood of a large current flowing through the switching element upon change of the duty ratio and therefore cannot solve the above problems.

SUMMARY

In view of the foregoing points, the present disclosure is aimed at surely preventing, regardless of environment and state, a large current from flowing through the switching element and safely changing the duty ratio.

A developing device according to an aspect of the present disclosure includes a developing roller, a magnetic roller, a capacitor, a transformer, a switching section, a control section, a temperature detecting section, and a storage section.

The developing roller is disposed to face a photosensitive drum and configured to carry toner thereon.

The magnetic roller is disposed to face the developing roller and configured to, using a magnetic brush technique, supply the toner to the developing roller and detach the toner from the developing roller.

The transformer is connected on a primary side thereof to the capacitor and configured to output from a secondary side thereof an AC voltage to be applied to the developing roller.

The switching section is connected to the capacitor and includes a switching element capable of switching between energization and de-energization of a series circuit, the series circuit including the capacitor and the transformer.

The control section is configured to generate a control signal for controlling the switching of the switching section and control the duty ratio of the control signal.

The temperature detecting section includes a single or a plurality of temperature detecting sections and is configured to detect the surrounding temperature around the capacitor and the transformer or the respective temperatures of the capacitor and the transformer.

The storage section stores, in association with temperatures detected by the temperature detecting section or sections, pieces of temperature characteristic data for determining the resonance period of the series circuit.

Furthermore, the control section changes the duty ratio of the control signal in multiple sequential steps to a desired duty ratio. When changing the duty ratio in the multiple sequential steps, the control section determines the resonance period of the series circuit based on the temperature detected with the temperature detecting section and the piece of temperature characteristic data associated with the detected temperature. The control section changes the duty ratio of the control signal to the next step during a changing time slot which is one of the first and second halves of a period of voltage fluctuation of the capacitor based on the determined resonance period, the one half in which the current flowing through the switching section is smaller than in the other half of the period.

A method according to another aspect of the present disclosure is a method for changing the duty ratio of a voltage to be applied to a developing roller by controlling switching of a switching section between energization and de-energization of a series circuit including a capacitor and a transformer configured to output from a secondary side thereof an AC voltage to be applied to the developing roller.

The method includes a temperature detecting step, a temperature characteristic data acquiring step, a resonance period acquiring step, a changing time slot detecting step, and a duty ratio changing step.

In the temperature detecting step, the surrounding temperature around the capacitor and the transformer or the respective temperatures of the capacitor and the transformer are detected.

In the temperature characteristic acquiring step, a piece of temperature characteristic data associated with the temperature detected in the temperature detecting step is acquired from a storage section storing pieces of temperature characteristic data for determining the resonance period of the series circuit.

In the resonance period acquiring step, the resonance period of the series circuit is determined based on the piece of temperature characteristic data acquired in the temperature characteristic data acquiring step.

In the changing time slot detecting step, a changing time slot is detected which is one of the first and second halves of a period of voltage fluctuation of the capacitor based on the resonance period acquired in the resonance period acquiring step, the one half in which the current flowing through the switching section is smaller than in the other half of the period.

The duty ratio changing step is employed in changing the duty ratio of a control signal in multiple sequential steps to a desired duty ratio, the control signal for controlling the switching of the switching section. In this step, the duty ratio of the control signal is changed to the next step during the changing time slot detected in the changing time slot detecting step.

BRIEF DESCRIPTION OF THE DRAWINGS

FIG. 11 is a table for illustrating an example of a set of pieces of temperature characteristic data for determining the resonance period.

FIG. 12 is a table for illustrating another example of the set of pieces of temperature characteristic data for determining the resonance period.

FIG. 13 is a flowchart showing an example of a processing flow upon change of the duty ratio of a control clock signal or the like.

FIG. 15 is a table for illustrating still another example of a set of pieces of temperature characteristic data for determining the resonance period.

DETAILED DESCRIPTION

A description will now be given of respective embodiments of a developing device and an image forming apparatus according to aspects of the present disclosure with reference to FIGS. 1 to 15. First, a first embodiment of the present disclosure is described with reference to FIGS. 1 to 13. The following embodiments describe as an example a tandem electrophotographic printer 100 (corresponding to an image forming apparatus) including developing devices 1. However, elements described in the present disclosure, such as structures and arrangements, are not intended to limit the scope of the invention and are simply illustrative.

(Overview of Image Forming Apparatus)

Figure 1:
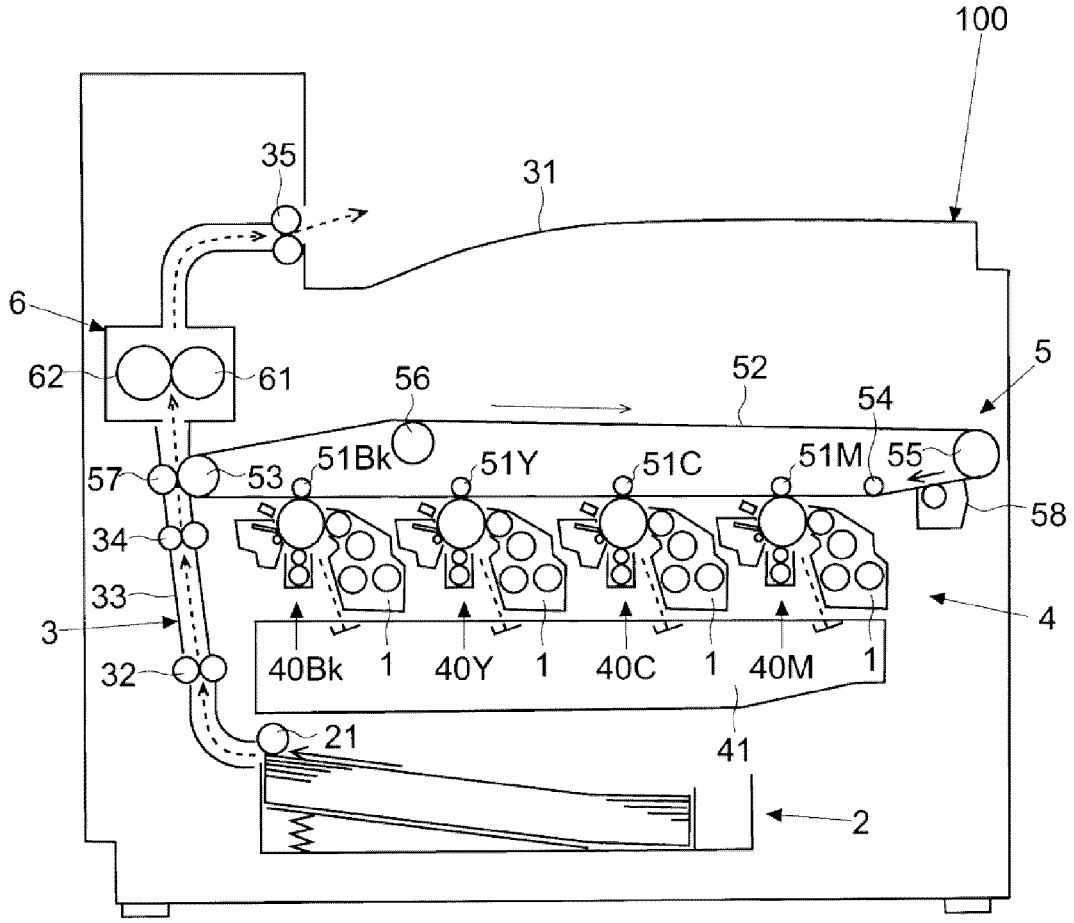
FIG. 1 is a cross-sectional view showing the structure of a printer.
Figure 2:
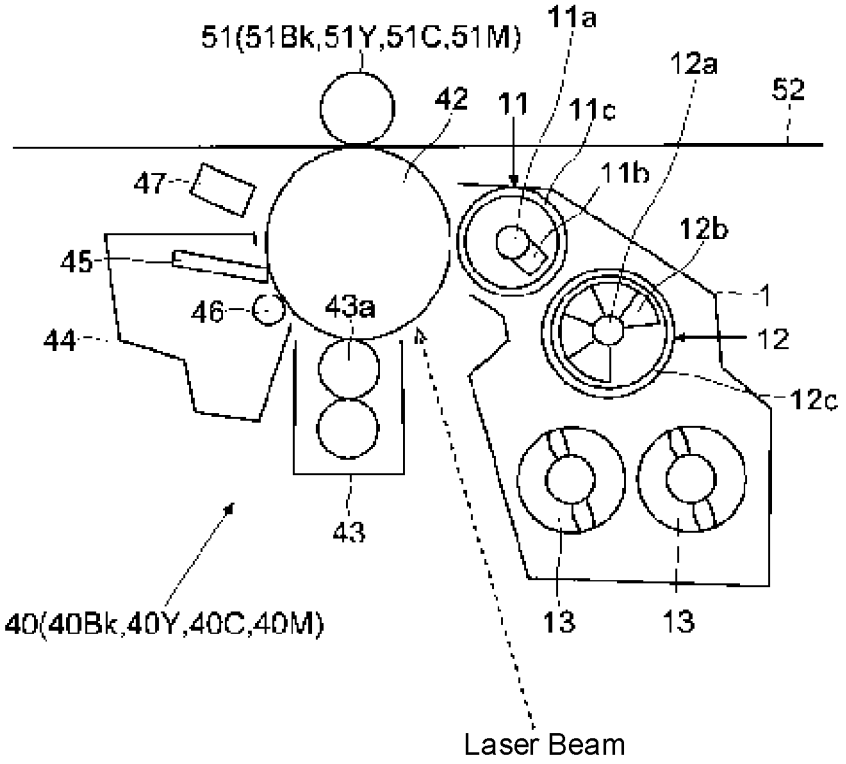
FIG. 2 is a cross-sectional view of an image forming unit.

The overview of the printer 100 according to the first embodiment is first described with reference to FIGS. 1 and 2. FIG. 1 is a cross-sectional view showing the structure of the printer 100. FIG. 2 is a cross-sectional view of an image forming unit 40. As shown in FIG. 1, the printer 100 of this embodiment is internally provided with a paper feed section 2, a paper conveyance section 3, an image forming section 4, an intermediate transfer section 5, and a fixing section 6.

For example, the paper feed section 2 contains various types of paper sheets, such as plain paper (OA paper), OHP paper, and label paper. The paper feed section 2 is provided with a paper feed roller 21 capable of being rotated by a drive mechanism (not shown), such as a motor, to feed paper sheets sheet by sheet to the paper conveyance section 3. Then, the paper conveyance section 3 guides the sheet supplied from the paper feed section 2 through the intermediate transfer section 5 and the fixing section 6 to a paper output tray 31. The paper conveyance section 3 is provided with a conveyance roller pair 32, a guide 33, a resist roller pair 34, and an output roller pair 35 and so on. The resist roller pair 34 allows the conveyed sheet to stay before the intermediate transfer section 5 and feeds it at an appropriate timing.

The image forming section 4 forms a toner image based on image data about an image to be formed. The image forming section 4 includes four image forming units 40Bk, 40Y, 40C, 40M for four colors and an exposure device 41. Specifically, the image forming section 4 includes an image forming unit 40Bk for forming a black image, an image forming unit 40Y for forming an yellow image, an image forming unit 40C for forming a cyan image, and an image forming unit 40M for forming a magenta image.

Now referring to FIG. 2, the image forming units 40Bk, 40Y, 40C, 40M are described in detail. The image forming units 40Bk, 40Y, 40C, 40M form toner images of different colors but basically have the same structure. Therefore, the following description is given taking the image forming unit 40Bk as an example typical of all the image forming units, wherein the references Bk, Y, C, and M representing colors are omitted unless otherwise specifically described. Common elements among all the image forming units are described only once by assigning the same reference to the relevant element in each image forming unit designated at 40.

The image forming unit 40 includes a photosensitive drum 42. The photosensitive drum 42 is rotatably supported. The photosensitive drum 42 is driven into rotation at a given circumferential speed by a drive force of a motor 74 (see FIG. 3). For example, the photosensitive drum 42 includes a body made of a metal, such as aluminum, and a photosensitive layer made of OPC (which may be replaced with amorphous silicon or the like) is formed on the outer periphery of the body. The photosensitive drum 42 can carry a toner image on the peripheral surface after being subjected to charging, light exposure, and development processes (i.e., act as an image carrier). Note that the photosensitive drum 42 in this embodiment is of positive charge type (and therefore the toner used is also of positive charge type).

A charging device 43 of the image forming unit 40 includes a charging roller 43*a*. The charging roller 43*a* is in contact with the associated photosensitive drum 42 and rotates with the rotation of the photosensitive drum 42. A voltage for charging the photosensitive drum 42 is applied to the charging roller 43*a*. The charging device 43 charges the surface of the photosensitive drum 42 at a uniform potential. The charging device 43 may charge the photosensitive drum 42 by corona discharge or using a brush or the like.

The exposure device 41 below the image forming unit 40 outputs laser light toward each photosensitive drum 42. For example, the exposure device 41 contains a plurality of optical element sets, each optical element set including a semiconductor laser element (laser diode), a polygon mirror, a polygon motor, a fθ lens, a mirror and so on, all of which are not shown. The exposure device 41 uses these optical element sets to irradiate the respective charged photosensitive drums 42 with respective optical signals (laser beams, shown in the broken line) based on color-resolved image signals of the image data. The exposure device 41 performs scanning exposure in this manner to form electrostatic latent images corresponding to the image data on the peripheral surfaces of the associated photosensitive drums 42. Specifically, each photosensitive drum 42 in this embodiment is positively charged, so that the portion thereof irradiated with light is reduced in potential. Positively-charged toner adheres to the portion of the photosensitive drum 42 reduced in potential. An exposure device 41 of a different type from the above type using the laser system, such as a type using an array of LEDs, may be used.

The developing device 1 in each image forming unit 40 contains a developer containing toner and magnetic carrier (a so-called "two-component developer") (wherein the image forming unit 40Bk contains a black developer, the image forming unit 40Y contains an yellow developer, the image forming unit 40C contains a cyan developer, and the image forming unit 40M contains a magenta developer). The developing device 1 is connected to a container (not shown) containing toner and supplied with the toner as needed with consumption of the toner.

The developing device 1 includes a developing roller 11, a magnetic roller 12, and conveying members 13. The developing roller 11 faces the associated photosensitive drum 42 so that their axes are parallel with each other. A gap (clearance) is provided between the developing roller 11 and the associated photosensitive drum 42. The gap has a predetermined width (for example, 1 mm or less).

In printing, a thin toner layer is formed on the peripheral surface of the developing roller 11 and the developing roller 11 carries charged toner. To allow the toner to fly to the photosensitive drum 42 and thereby develop an electrostatic latent image on the photosensitive drum 42, a voltage is applied to the developing roller 11 (see, for example, FIG. 4, the details of which will be described later).

The magnetic roller 12 of the developing device 1 faces the associated developing roller 11 so that their axes are parallel with each other. To supply toner to the developing roller 11 and recover and detach the toner from the developing roller 11, a voltage is applied to the magnetic roller 12 (see, for example, FIG. 4, the details of which will be described later).

The developing device 1 of this embodiment includes two conveying members 13. The conveying members 13 are disposed below the magnetic roller 12. For example, the conveying members 13 have their respective spiral blades to convey the developer containing the toner and the carrier while stirring it. The toner is charged by friction with the carrier upon the conveyance. The two conveying members 13 have different rotating directions.

A roller pin 11*a* of the developing roller 11 and a roller pin 12*a* of the magnetic roller 12 are fixed by and supported to a support member (not shown) or the like. The roller pin 11*a* of the developing roller 11 is provided with a magnet 11*b* attached thereto to extend in an axial direction and having an approximately rectangular cross-section. The roller pin 12*a* of the magnetic roller 12 is provided with magnets 12*b* attached thereto to extend in an axial direction and having an approximately sectorial cross-section. The developing roller 11 and the magnetic roller 12 include their respective cylindrical sleeves 11*c* and 12*c* disposed out of contact with the magnet 11*b* and the magnets 12*b*, respectively, and covering the magnet 11*b* and magnets 12*b*, respectively. The sleeves 11*c*, 12*c* are rotated by unshown drive mechanisms.

At a position where the developing roller 11 and the magnetic roller 12 face each other, the magnet 11*b* of the developing roller 11 and one of the magnets 12*b* of the magnetic roller 12 are opposed in opposite polarities to each other. Thus, a magnetic brush is formed between the developing roller 11 and the magnetic roller 12 by the magnetic carrier. The toner is supplied to the developing roller 11, such as by the rotation of the sleeve 12*c* of the magnetic roller 12 carrying the magnetic brush and the application of voltage to the magnetic roller 12, so that a thin toner layer is formed on the sleeve 11*c* of the developing roller 11. Furthermore, after the electrostatic latent image is formed by the toner on the surface of the photosensitive drum 42, a magnetic brush detaches and recovers the residual toner on the surface of the developing roller 11.

A cleaning device 44 of the image forming unit 40 cleans the photosensitive drum 42. Each cleaning device 44 extends in the axial direction of the photosensitive drum 42 and includes: a blade 45 made of, for example, resin; and a rubbing roller 46 for rubbing against the surface of the photosensitive drum 42 to remove residual toner and so on. The blade 45 and the rubbing roller 46 engage against the photosensitive drum 42 to scrape out and remove dirt, such as residual toner, on the photosensitive drum 42. Furthermore, a destaticizing device 47 (for example, an array of LEDs) for irradiating the photosensitive drum 42 with light to destaticize it is provided above the cleaning device 44.

Referring back to FIG. 1, the description is continued. The intermediate transfer section 5 undergoes a primary transfer of a toner image from the photosensitive drum 42 and performs a secondary transfer of the toner image to a sheet. The intermediate transfer section 5 includes a plurality of primary transfer rollers 51Bk, 51Y, 51C, 51M, an intermediate transfer belt 52, a drive roller 53, driven rollers 54, 55, 56, a secondary transfer roller 57, a belt cleaning device 58 and so on.

The intermediate transfer belt 52 is made of, for example, a dielectric resin and mounted around the first transfer rollers 51Bk, 51Y, 51C, 51M, the drive roller 53, and the driven rollers 54, 55, 56. By the rotary drive of the drive roller 53 connected to a drive mechanism (not shown), such as a motor, the intermediate transfer belt 52 runs to make a loop in the clockwise direction of the plane of FIG. 1. The primary transfer rollers 51Bk, 51Y, 51C, 51M and the associated photosensitive drums 42 hold the endlessly movable intermediate transfer belt 52 between them. A voltage for primary transfer is applied to each of the primary transfer rollers 51Bk, 51Y, 51C, 51M. The toner images (including black-, yellow-, cyan-, and magenta-colored images) formed by the individual image forming units 40 are primarily transferred to the intermediate transfer belt 52 while being sequentially superimposed one on another without misalignment.

Furthermore, the drive roller 53 and the secondary transfer roller 57 form a secondary transfer nip with the intermediate transfer belt 52 therebetween. A predetermined voltage is applied to the secondary transfer roller 57. Then, the toner image, including the colors superimposed one on another, on the intermediate transfer belt 52 is secondarily transferred to a sheet. Residual toner and so on on the intermediate transfer belt 52 after the secondary transfer is removed and recovered by the belt cleaning device 58.

The fixing section 6 is disposed downstream of the secondary transfer position in the direction of conveyance of the sheet. The fixing section 6 includes a fixing roller 61 containing a heat source; and a pressure roller 62 pressed against the fixing roller 61. The sheet having the toner image transferred thereto pass through a nip between the fixing roller 61 and the pressure roller 62 of the fixing section 6. When the sheet passes through the fixing nip, the toner image is heated and pressed, resulting in fixation of the toner image on the sheet. The sheet after the fixation is ejected to the paper output tray 31, resulting in completion of printing of a single paper sheet.

(Hardware Configuration of Printer 100)

Figure 3:
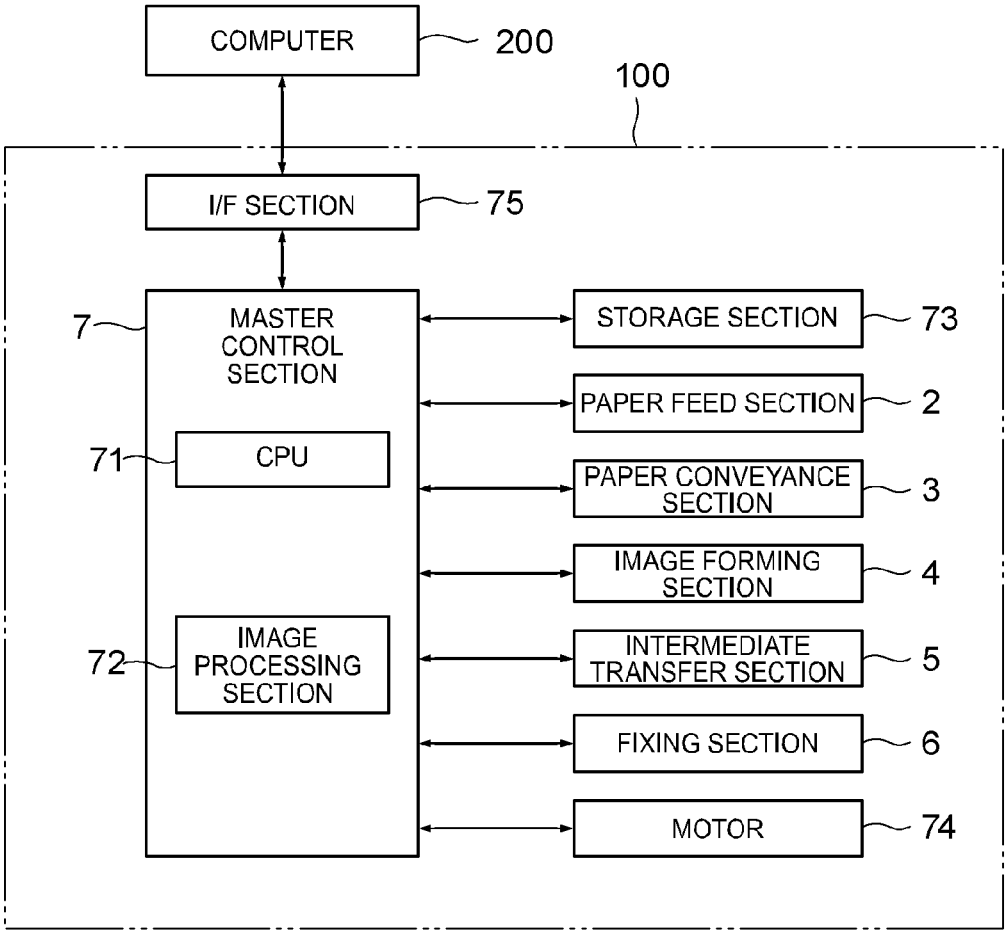
FIG. 3 is a block diagram showing an example of a hardware configuration of the printer.

The hardware configuration of the printer 100 according to the first embodiment is next described with reference to FIG. 3. FIG. 3 is a block diagram showing an example of the hardware configuration of the printer 100.

As shown in FIG. 3, the printer 100 according to this embodiment includes a master control section 7 (corresponding to a control section). The master control section 7 controls the components of the printer 100. For example, the master control section 7 includes circuits and elements for processing a CPU 71, an image processing section 72 and so on. The printer 100 is provided with a storage device 73 (corresponding to a storage section). For example, the storage device 73 is a combination of volatile and non-volatile storage elements, such as a ROM, a RAM, and a flash ROM. This embodiment describes an example in which the master control section 7 controls printing. However, the master control section 7 may be divided on a function or role basis into a plurality of control sections (substrates), such as an engine control section for the control of the print-related sections and a main control section for overall control and image processing.

The CPU 71 is a central processing unit and performs the control on and arithmetic operation for components of the printer 100, based on a control program which is stored in the storage device 73 and will be appropriately loaded. For example, the storage device 73 can store, in addition to the control program of the printer 100, various data, such as control data. The storage device 73 also stores programs and data relating to the setting of voltages to be applied to the developing roller 11 and the magnetic roller 12, such as set values of duty ratios and DC bias voltages upon application of voltage to the developing roller 11 and the magnetic roller 12.

The master control section 7 is connected to the paper feed section 2, the paper conveyance section 3, the image forming section 4, the intermediate transfer section 5, the fixing section 6, and so on and controls the operation of these sections to enable appropriate image formation based on the control program and data in the storage device 73. Furthermore, the master control section 7 controls a single or a plurality of motors 74 provided inside the printer 100. The master control section 7 causes the motors 74 to be driven to rotate various rotating bodies, including the photosensitive drums 42, the developing rollers 11, and the magnetic rollers 12. By the use of the drive of the motors 74, the sleeves 11*c*, 12*c* of the developing rollers 11 and the magnetic rollers 12 rotate.

Moreover, the master control section 7 is connected through an I/F section 75 (interface section) to a computer 200 (such as a personal computer). The computer 200 is a source of print data containing the contents of printing to be done by the printer 100. For example, the print data contains print setting data and image data. The master control section 7 causes the image processing section 72 to process an image based on the received print data to generate image data for the exposure device 41. The exposure device 41 receives the image data and forms electrostatic latent images on the individual associated photosensitive drums 42.

(Voltage Application in Developing Device 1)

Figure 4:
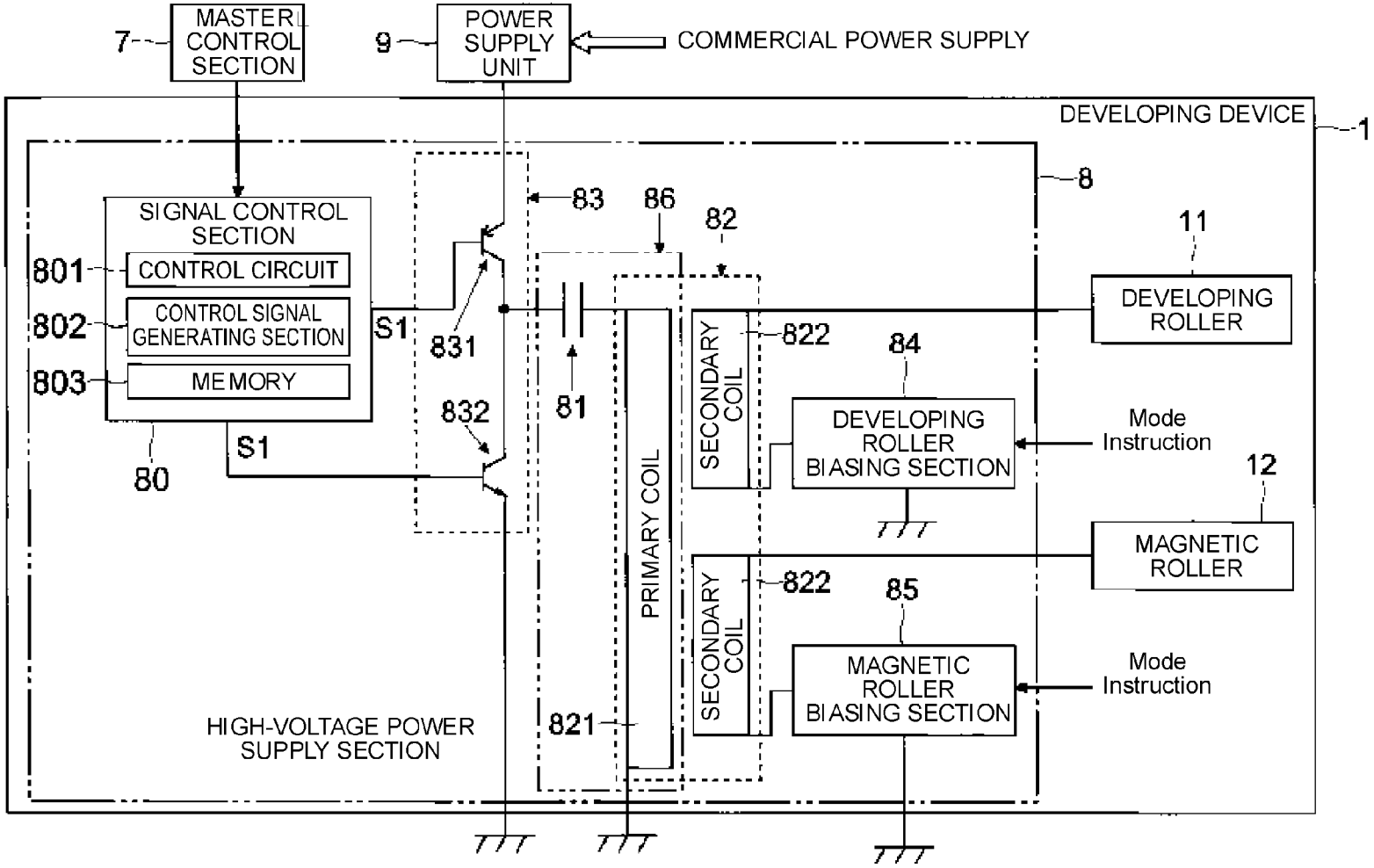
FIG. 4 is a block diagram showing an example of a developing device.
Figure 5:
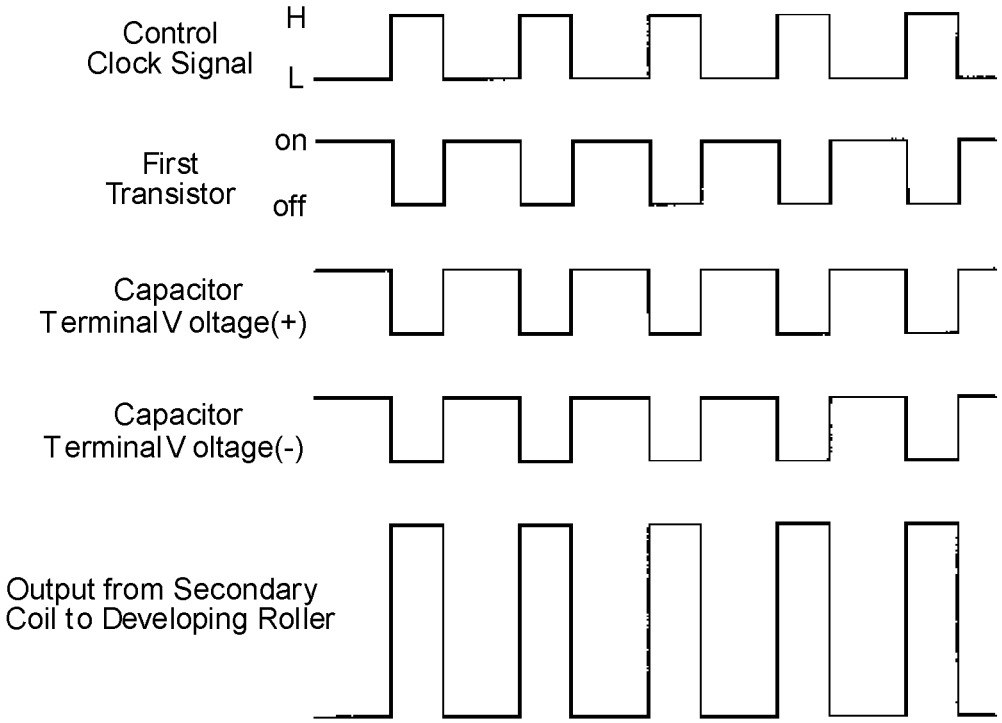
FIG. 5 is a timing chart showing respective examples of waveforms of various voltages in a high-voltage power supply section of the developing device.

An example of the manner of voltage application in the developing device 1 is next described with reference to FIGS. 4 and 5. FIG. 4 is a block diagram showing an example of the developing device 1. FIG. 5 is a timing chart showing respective examples of waveforms of various voltages in a high-voltage power supply section 8 of the developing device 1.

As described previously, the developing device 1 in this embodiment is provided with the developing roller 11 and the magnetic roller 12. For the purposes of development of an electrostatic latent image with toner, supply of the toner from the magnetic roller 12 to the developing roller 11, and detachment of the toner from the developing roller 11, voltages are applied to the developing roller 11 and the magnetic roller 12.

In other words, to appropriately move the toner, voltages are applied to the developing roller 11 and the magnetic roller 12.

The developing device 1 includes a high-voltage power supply section 8 in order to apply voltages to the developing roller 11 and the magnetic roller 12. The high-voltage power supply section 8 performs boosting or the like of the voltage supplied and then applies (outputs) the voltage to the developing roller 11 and the magnetic roller 12.

For example, the high-voltage power supply section 8 in this embodiment includes a signal control section 80 (corresponding to a control section), a capacitor 81, a transformer 82, a switching section 83, a developing roller biasing section 84, and a magnetic roller biasing section 85. Because the developing devices 1 of the image forming unit 40Bk, 40Y, 40C, 40M have different timings of start and end of development, such high-voltage power supply sections 8 are provided one for each developing device 1 (each combination of the developing roller 11 and the magnetic roller 12).

For example, an electrolytic capacitor is used as the capacitor 81. One of the electrodes of the capacitor 81 is connected to the switching section 83. The other electrode of the capacitor 81 is connected to a primary coil 821 of the transformer 82. Thus, the capacitor 81 and the transformer 82 are connected as a series circuit 86 (the series circuit 86 including the capacitor 81 and the transformer 82 is shown in the dashed-three dotted line in FIG. 4). The capacitor 81 supplies to the primary coil 821 of the transformer 82 a signal in which a DC component is removed from a signal (voltage) output by the switching section 83.

The signal control section 80 generates a control clock signal S1 (corresponding to a control signal) to be input to the capacitor 81 and outputs it to the switching section 83. The signal control section 80 changes the duty ratio of the control clock signal S1 based on an instruction of the master control section 7 depending upon the mode of the printer 100 and whether a development is executed or not. An AC voltage having a similar duty ratio to that of the control clock signal S1 output by the signal control section 80 is applied to the developing roller 11 (the details of which will be described later). Therefore, the signal control section 80 controls the duty ratio of the control clock signal S1 to thereby control the duty ratio of the AC voltage to be applied to the developing roller 11.

The signal control section 80 includes a control circuit 801 (for example, a CPU or a microcomputer) configured to govern the control on the operation of the signal control section 80, a control signal generating section 802 configured to generate a control clock signal S1 having a duty ratio based on an instruction of the control circuit 801, and a memory 803 (corresponding to a storage section) storing data about the control of generation of the control clock signal S1. Furthermore, for example, the switching section 83 includes a first transistor 831 (corresponding to a switching element) and a second transistor 832 (corresponding to a switching element).

The signal control section 80 gives to each of the first and second transistors 831, 832 a control clock signal S1 regulated in voltage value or the like appropriately for the associated transistor (wherein the frequency of the control clock signal S1 can be about several kHz, such as about 3 to about 5 kHz). The first transistor 831 is, for example, a pnp transistor. The first transistor 831 is turned OFF at a high level of the control clock signal S1 and turned ON at a low level thereof.

The emitter of the first transistor 831 is connected to a power supply unit 9. The power supply unit 9 is provided inside the printer 100 and commercial power is input to the power supply unit 9. The power supply unit 9 performs the rectification, smoothing and so on of the input power and outputs a DC voltage. For example, the power supply unit 9 outputs a DC voltage of 24 V and applies it to the first transistor 831. The base of the first transistor 831 is connected to the signal control section 80. The collector of the first transistor 831 is connected to the second transistor 832 and the capacitor 81.

The second transistor 832 is a npn transistor. The base of the second transistor 832 is connected to the signal control section 80, the collector thereof is connected to the collector of the first transistor 831 and the capacitor 81, and the emitter thereof is connected to the ground. The second transistor 832 is turned ON at a high level of the control clock signal S1 and turned OFF at a low level thereof. Therefore, the second transistor 832 is in the OFF state when the first transistor 831 is in the ON state. On the other hand, the second transistor 832 is in the ON state when the first transistor 831 is in the OFF state.

Since the first transistor 831 is of pnp type and connected at the collector thereof to the capacitor 81, a voltage of the inverted logic state of the control clock signal S1 is applied to the capacitor 81. In other words, a signal inverted in logic relative to and amplified from the control clock signal S1 is generated at the collector of the first transistor 831. The voltage applied to the capacitor 81 has the same frequency as the control clock signal S1 and the duty ratio of the voltage is 1 minus the duty ratio of the control clock signal S1. Therefore, the duty ratio of the voltage to be applied to the capacitor 81 plus the duty ratio of the control clock signal S1 make 1. For example, if the duty ratio of the control clock signal S1 is 10%, the duty ratio of the voltage to be applied to the capacitor 81 is 90%.

The capacitor 81 is connected to the collector of the first transistor 831. Furthermore, the capacitor 81 is connected to the primary side (primary coil 821) of the transformer 82. The capacitor 81 supplies to the transformer 82 a signal (voltage) in which a DC component is removed from the voltage applied by ON/OFF of the first transistor 831. In other words, an AC waveform is input to the transformer 82.

The transformer 82 outputs a voltage boosted from the voltage input to the primary side. On the other hand, the secondary side has at least two output lines, one of them connected to the developing roller 11 and the other connected to the magnetic roller 12. The rate of boosting of voltage may differ between outputs. The output of the transformer 82 for the developing roller 11 is provided with a developing roller biasing section 84 configured to bias the AC voltage to be applied to the developing roller 11. Likewise, the output of the transformer 82 for the magnetic roller 12 is provided with a magnetic roller biasing section 85 configured to bias the AC voltage to be applied to the magnetic roller 12. An AC voltage biased with a DC voltage by the developing roller biasing section 84 is applied to the developing roller 11. An AC voltage biased with a DC voltage by the magnetic roller biasing section 85 is applied to the magnetic roller 12.

Each of the developing roller biasing section 84 and the magnetic roller biasing section 85 is formed of, for example, a converter for performing voltage boosting based on the output voltage of the power supply unit 9. Furthermore, the developing roller biasing section 84 and the magnetic roller biasing section 85 are circuits capable of changing the outputs. In other words, the developing roller biasing section 84 and the magnetic roller biasing section 85 can change the magnitude of the bias voltage.

A description is now given of respective examples of waveforms of various voltages in the high-voltage power supply section 8 of the developing device 1 with reference to FIG. 5. The chart shown in the top panel of FIG. 5 is a chart showing a control clock signal S1. The ON/OFF of the second transistor 832 is the same as the chart shown in the top panel of FIG. 5. The chart shown in the second panel of FIG. 5 is a chart showing the ON/OFF of the first transistor 831. As shown in FIG. 5, the ON/OFF timing of the first transistor 831 and the logic of the control clock signal S1 are inverted relative to each other. The chart shown in the third panel of FIG. 5 is a chart showing the transition of voltage at the positive electrode of the capacitor 81. The chart shown in the fourth panel of FIG. 5 is a chart showing the transition of voltage at the negative electrode of the capacitor 81. As shown in the charts of the third and fourth panels, when the first transistor 831 is turned ON, the output voltage of the power supply unit 9 is applied to the capacitor 81. When the first transistor 831 is turned OFF, the second transistor is turned ON, so that the capacitor 81 is discharged through the second transistor 832. In this embodiment, when a control clock signal S1 is generated, the capacitor 81 stores an electric charge according to the duty ratio of the control clock signal S1.

The chart shown in the bottom panel of FIG. 5 is an example of an output waveform of the secondary coil 822 for the developing roller 11. As shown in FIG. 5, the transformer 82 in this embodiment is of a type in which a waveform reverse in logic relative to the voltage applied to the capacitor 81 is output (inverted output type). In other words, the secondary coil 822 for the developing roller 11 outputs a waveform having inverted High and Low relative to the voltage applied to the capacitor 81. Therefore, the AC voltage applied to the developing roller 11 and the control clock signal S1 have the same waveform and the same duty ratio.

(Modes of Voltage Application in Developing Device 1)

Figure 6:
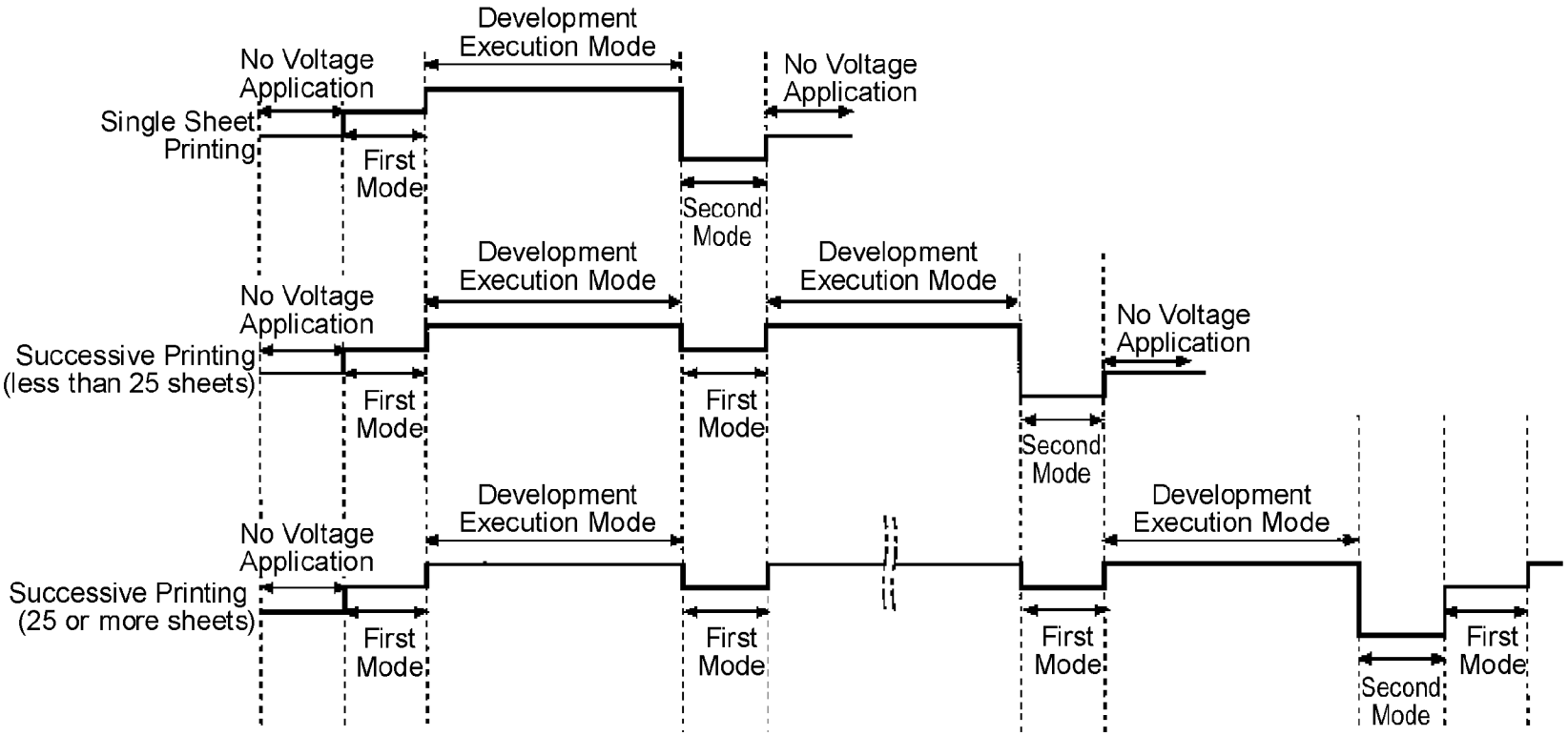
FIG. 6 is a chart for illustrating examples of transitions among various modes of voltage application.

Modes of voltage application in the developing device 1 in the first embodiment are next described with reference to FIG. 6. FIG. 6 is a chart for illustrating examples of transitions among various modes of voltage application.

The developing device 1 of this embodiment has: a development execution mode where an electrostatic latent image is developed with toner; and a development unexecution mode where an electrostatic latent image is not yet developed. The development unexecution mode further includes a first mode and a second mode. The high-voltage power supply section 8 of the developing device 1 changes, for each mode, the magnitudes of DC voltages to be applied to the developing roller 11 and the magnetic roller 12 and the duty ratio of the control clock signal S1 (the duty ratio of the voltage to be applied to the capacitor 81). When no printing is performed, there is no need to apply any voltage to the developing roller 11 and the magnetic roller 12. Therefore, the states (modes) of the developing device 1 include, besides the above three modes (the development execution mode, the first mode, and the second mode), a non-application mode where no voltage is applied to the developing roller 11 and the magnetic roller 12.

The development execution mode is a mode where toner is flown to develop an electrostatic latent image on the photosensitive drum 42. The first mode (a form of the development unexecution mode) is a mode before the transition to the development execution mode, wherein toner is supplied to the developing roller 11 to set a thin toner layer on the surface (sleeve 11*c*) of the developing roller 11. The second mode (another form of the development unexecution mode) is a mode for detaching and recovering the toner from the surface of the developing roller 11, wherein the toner on the surface of the developing roller 11 is replaced with new toner to prevent the residual toner from sticking to the developing roller 11.

First, in the development execution mode, an AC voltage having a predetermined peak-to-peak voltage is applied to the developing roller 11. Furthermore, in the development execution mode, to supply toner to the developing roller 11, the developing roller biasing section 84 and the magnetic roller biasing section 85 output DC voltages so that the developing roller biasing section 84 has a smaller output voltage value than the magnetic roller biasing section 85. In other words, the output voltage of the magnetic roller biasing section 85 is greater than that of the developing roller biasing section 84, which facilitates the movement of positively charged toner from the magnetic roller 12 toward the developing roller 11.

Next, the first mode is a mode for forming a thin toner layer on the peripheral surface of the developing roller 11 prior to printing. Therefore, it is necessary to apply a bias to allow the charged toner to move from the magnetic roller 12 to the developing roller 11. To achieve this, like the development execution mode, the developing roller biasing section 84 and the magnetic roller biasing section 85 output DC voltages so that the developing roller biasing section 84 has a smaller output voltage value than the magnetic roller biasing section 85. Furthermore, in the first mode, an AC voltage having a predetermined peak-to-peak voltage may be applied to the developing roller 11.

The second mode is a mode for detaching the toner from the peripheral surface of the developing roller 11 and recovering the toner to the magnetic roller 12. Therefore, it is necessary to apply a bias to facilitate the movement of the toner from the developing roller 11 to the magnetic roller 12. To achieve this, in the second mode, the developing roller biasing section 84 and the magnetic roller biasing section 85 output DC voltages so that the developing roller biasing section 84 has a larger output voltage value than the magnetic roller biasing section 85. Thus, the positively charged toner moves from the developing roller 11 towards the magnetic roller 12. Furthermore, also in the second mode, an AC voltage having a predetermined peak-to-peak voltage may be applied to the developing roller 11.

The transition from the first or second mode to one of the other modes is made, for example, at or after the time when the developing roller 11 rotates one revolution after the transition to the first or second mode. In other words, the first mode and the second mode are continued at least during a period of time taken for one revolution of the developing roller 11.

For example, depending upon the state of the printer 100, the master control section 7 gives a signal instructing one of the above modes to the developing roller biasing section 84 and the magnetic roller biasing section 85. The developing roller biasing section 84 and the magnetic roller biasing section 85 change the magnitudes of the output voltage values according to the instructed mode.

FIG. 6 shows examples of three types of mode transitions. The uppermost panel of FIG. 6 shows a state transition in the case of printing of a single sheet. In the case of printing of a single sheet, the master control section 7 controls the high-voltage power supply section 8 to change the developing device 1 from the non-application mode prior to the start of development to the first mode to form a thin toner layer on the surface (sleeve 11*c*) of the developing roller 11. Thereafter, the master control section 7 controls the high-voltage power supply section 8 to change the developing device 1 to the development execution mode to continue toner supply from the magnetic roller 12 to the developing roller 11. Then, upon completion of development (completion of printing), the master control section 7 controls the high-voltage power supply section 8 to change the developing device 1 to the second mode to recover the toner from the developing roller 11. Thereafter, the developing device 1 undergoes transition to the non-application mode.

The middle panel of FIG. 6 shows a state transition in the case of successive printing of a plurality of sheets less than 25 sheets. The printing manner in this case is the same as in the case of printing of a single sheet until the start of development. Then, when the development of a toner image for a first sheet is started, the master control section 7 controls the high-voltage power supply section 8 to change the developing device 1 to the first mode interval between the sheets. Therefore, the first mode and the development execution mode are alternately repeated. Then, when the development (printing) based on the job is completed, the master control section 7 controls the high-voltage power supply section 8 to change the developing device 1 to the second mode. Thereafter, the developing device 1 undergoes transition to the non-application mode.

The bottom panel of FIG. 6 shows a state transition in the case of successive printing of a plurality of sheets not less than 25 sheets. The printing manner in this case is also the same as in the case of printing of a single sheet until the start of development. Then, when the development of a toner image for a first sheet is started, the master control section 7 principally controls the high-voltage power supply section 8 to change the developing device 1 to the first mode during the sheet interval. Therefore, the first mode and the development execution mode are alternately repeated. Then, upon completion of printing up to 25 sheets, the master control section 7 controls the high-voltage power supply section 8 to change the developing device 1 to the second mode to refresh the toner on the peripheral surface of the developing roller 11. The second mode is executed after every printing of 25 sheets. After the second mode, the master control section 7 controls the high-voltage power supply section 8 to change the developing device 1 to the first mode again and then allow the restart of the development. Then, when the development (printing) is completed, the master control section 7 controls the high-voltage power supply section 8 to change the developing device 1 to the second mode. Thereafter, the developing device 1 undergoes transition to the non-application mode. The description of this embodiment shows an example in which the second mode is executed on the basis of end of every printing of 25 sheets. However, the present disclosure is not limited to the above basis and the basis may be the end of every printing of 26 sheets or more or the end of every printing of 24 sheets or less.

(Duty Ratio in Each Mode)

Figure 7:
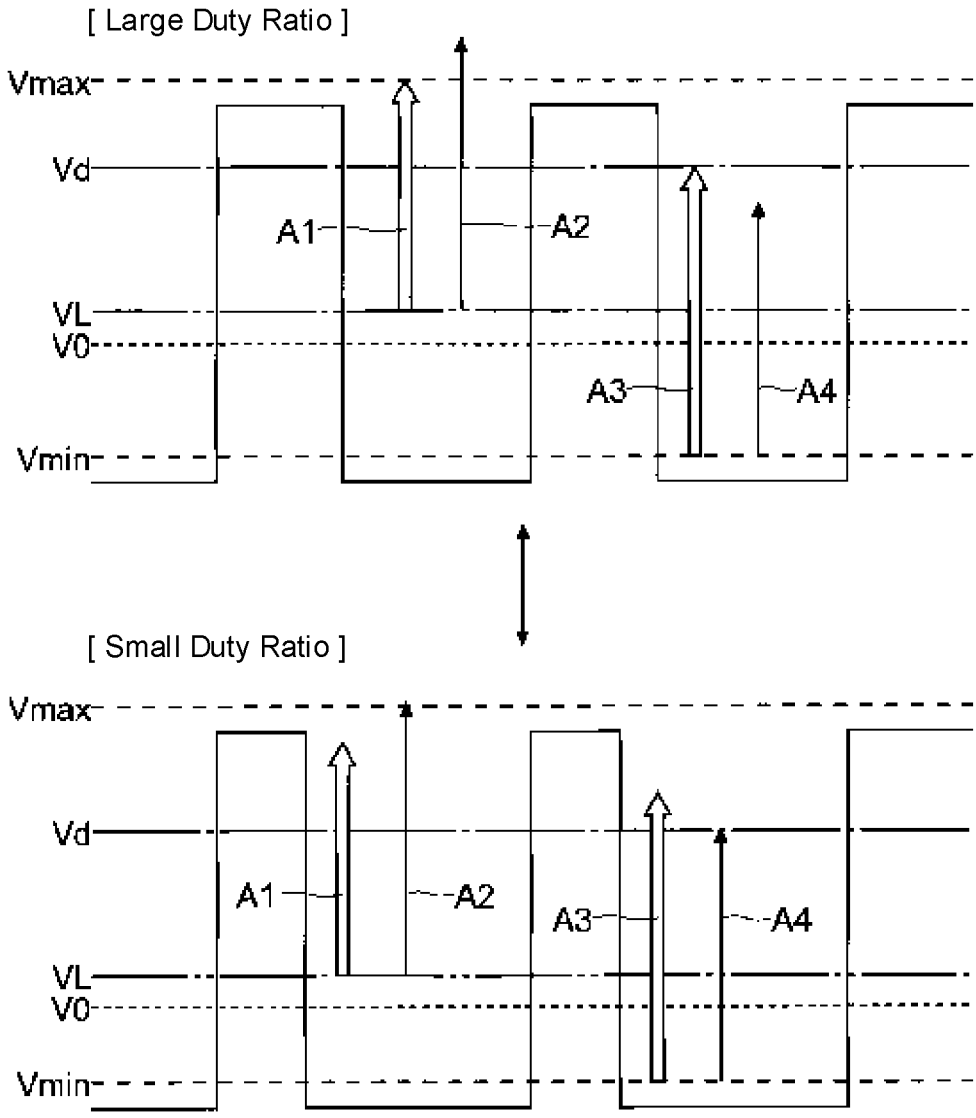
FIG. 7 is a diagram for illustrating an effect due to a difference between duty ratios of voltage to be applied to the developing roller.

Changes of the mode of voltage application and the duty ratio in the developing device 1 of the first embodiment are next described with reference to FIG. 7. FIG. 7 is a chart for illustrating an effect due to a difference between duty ratios of voltage to be applied to the developing roller 11.

In the printer 100 of this embodiment, by changing the duty ratio of the control clock signal S1, the duty ratio of the AC voltage to be applied to the developing roller 11 and the duty ratio of the voltage to be applied to the capacitor 81 are changed. Specifically, the control signal generating section 802 changes, depending upon the mode of the developing device 1, the duty ratio of the control clock signal S1 (the duty ratio of switching of the first transistor 831). In the development execution mode, the control signal generating section 802 makes the duty ratio of the control clock signal S1 (the voltage to be applied to the developing roller 11) greater than in the first and second modes. In this case, based on the inverted output relation, the duty ratio of the voltage to be applied to the capacitor 81 is made smaller.

A description is given first of how the manner of flying of the toner varies depending upon the duty ratio with reference to FIG. 7. FIG. 7 shows exemplary waveforms of voltage to be applied to the developing roller 11. The duty ratio (about 40%) of voltage to be applied to the developing roller 11 shown in the upper timing chart of FIG. 7 is greater than the duty ratio (about 30%) of voltage to be applied to the developing roller 11 shown in the lower timing chart of FIG. 7.

First, the solid line in each timing chart of FIG. 7 shows a waveform representing fluctuation in voltage to be applied to the developing roller 11. Therefore, the ordinate in each timing chart shows the amplitude of voltage. The peak-to-peak voltage in this waveform is set within the range of, for example, 1 kV to 2 kV. The line V0 (the broken line) in FIG. 7 shows 0 V (ground).

The capacitor 81 removes a DC component from the input signal. Therefore, the level of the line V0 in the peak-to-peak voltage of the waveform representing fluctuation in voltage to be applied to the developing roller 11 is a level (the area center) at which the product of the High time of one period and the magnitude becomes equal to the product of the Low time of one period and the magnitude. For example, if the duty ratio of a voltage of rectangular wave is 40% and the peak-to-peak voltage is 1000 V, the potential difference from the line V0 to the positive peak of the wave is 600 V and the potential difference from the line V0 to the negative peak of the wave is 400 V.

The line VL (the dashed-two dotted line) in each timing chart of FIG. 7 represents the potential (for example, about 100 to about 200 V) of the photosensitive drum 42 after the exposure. The line Vd (the dash-dotted line) in each timing chart of FIG. 7 represents the potential (for example, about 400 to about 600 V) of the charged photosensitive drum 42. The line Vmax (the upper widely-spaced broken line) in each timing chart of FIG. 7 represents the positive peak value of a voltage to be applied to the developing roller 11 when biased by the developing roller biasing section 84. The line Vmin (the lower widely-spaced broken line) in each timing chart of FIG. 7 represents the negative peak value of the voltage to be applied to the developing roller 11 when biased by the developing roller biasing section 84.

Upon development, positively-charged toner is flown from the developing roller 11 to a portion of the photosensitive drum 42 exposed to light. Therefore, as the difference between the potential (VL) of the photosensitive drum 42 after the exposure and Vmax is larger, the electrostatic force on the toner becomes greater and the moving speed of the toner becomes higher.

Referring now to FIG. 7, based on the viewpoint of the area center, the potential difference (shown by the solid arrow A2 in FIG. 7) between the potential (VL) of the photosensitive drum 42 after the exposure and Vmax when the duty ratio of the voltage to be applied to the developing roller 11 is small becomes larger than the potential difference (shown by the open arrow A1 in FIG. 7) between the potential (VL) of the photosensitive drum 42 after the exposure and Vmax when the duty ratio of the voltage to be applied to the developing roller 11 is large. Therefore, as the duty ratio is smaller, the toner can be more sharply flown to and more rapidly deposited on the exposed dots. Thus, it is said that the smaller the duty ratio, the higher the reproducibility per dot.

However, it is known from experience that as the duty ratio of the voltage to be applied to the developing roller 11 is smaller, the developed toner image is more likely to exhibit unevenness. For example, among solid images with the same concentration, as the duty ratio of the voltage to be applied to the developing roller 11 is smaller, the print result is more likely to exhibit concentration unevenness (referred to also as "development drive unevenness"). Although the mechanism of occurrence of unevenness due to drive variation is not completely figured out, it can be attributed to productive errors or assembly errors of the developing roller 11 and the photosensitive drum 42. Owing to these errors, the gap between the photosensitive drum 42 and the developing roller 11 varies in width from point to point in the axial direction and, additionally, the gap further varies with their rotations. Furthermore, it is assumed that as the reproducibility per dot is increased, the deflection of the gap is more likely to appear in the form of unevenness.

On the other hand, it is also known from experience that as the duty ratio of the voltage to be applied to the developing roller 11 is increased, leakage (discharge) is more likely to occur. Because the gap between the photosensitive drum 42 and the developing roller 11 is slight (1 mm), the larger the potential difference between the photosensitive drum 42 and the developing roller 11, the more leakage is likely to occur.

In the developing device 1 of this embodiment, leakage is likely to occur when the voltage to be applied to the developing roller 11 becomes small. Furthermore, as the negative peak of voltage to be applied to the developing roller 11 is smaller (more negative), leakage is more likely to occur. Depending upon the charge characteristics of the toner and the photosensitive drum 42, leakage may be more likely to occur as the voltage to be applied to the developing roller 11 is larger.

Referring again to FIG. 7, based on the viewpoint of the area center, the difference (shown by the open arrow A3 in FIG. 7) between the potential (Vd) of the photosensitive drum 42 after the charging and the potential (Vmin) of the negative peak of voltage to be applied to the developing roller 11 when the duty ratio of the voltage to be applied to the developing roller 11 is large is greater than the difference (shown by the solid arrow A4 in FIG. 7) between the potential (Vd) of the photosensitive drum 42 after the charging and the potential (Vmin) of the negative peak of voltage to be applied to the developing roller 11 when the duty ratio of the voltage to be applied to the developing roller 11 is small. In other words, as the duty ratio of the voltage to be applied to the developing roller 11 is greater, the developing device 1 of this embodiment is more likely to cause leakage.

If leakage occurs, the photosensitive drum 42 may drop the potential and thus adsorb toner. If toner adsorbs on the photosensitive drum 42 except during execution of development, the intermediate transfer belt 52 and the secondary transfer roller 57 may be contaminated with the toner. Thus, the toner may adhere to a paper sheet and thus contaminate it. Furthermore, if the current at the leakage is large, a tiny hole may be pierced in the photosensitive drum 42 to degrade the image quality of the toner image to be formed after that.

In order to reduce the unevenness of the toner image and improve the image quality, the high-voltage power supply section 8 (signal control section 80) in the printer 100 of this embodiment makes the duty ratio of the voltage to be applied to the developing roller 11 (the duty ratio of the control clock signal S1) in the development execution mode greater than in the first and second modes. On the other hand, in order to prevent occurrence of leakage, the high-voltage power supply section 8 (signal control section 80) makes the duty ratio of the voltage to be applied to the developing roller 11 (the duty ratio of the control clock signal S1) in the first and second modes smaller than in the development execution mode. In this manner, the duty ratios in the development execution mode, the first mode, and the second mode are previously set.

The master control section 7 gives the signal control section 80 a mode instruction representing the mode for the developing device 1 depending upon, for example, the printing process, the state of the printer 100, and the number of paper sheets to be printed. For example, the master control section 7 instructs the signal control section 80 to transition to the development execution mode upon start of exposure of the exposure device 41. Furthermore, the master control section 7 instructs the signal control section 80 to transition to the first mode or the second mode upon end of the exposure of the exposure device 41. The signal control section 80 changes the duty ratio according to the mode instruction from the master control section 7. Alternatively, the master control section 7 may give the signal control section 80 a signal indicating the duty ratio itself and the signal control section 80 may change the duty ratio according to the indication.

(Stepwise Change of Duty Ratio)

Figure 8:
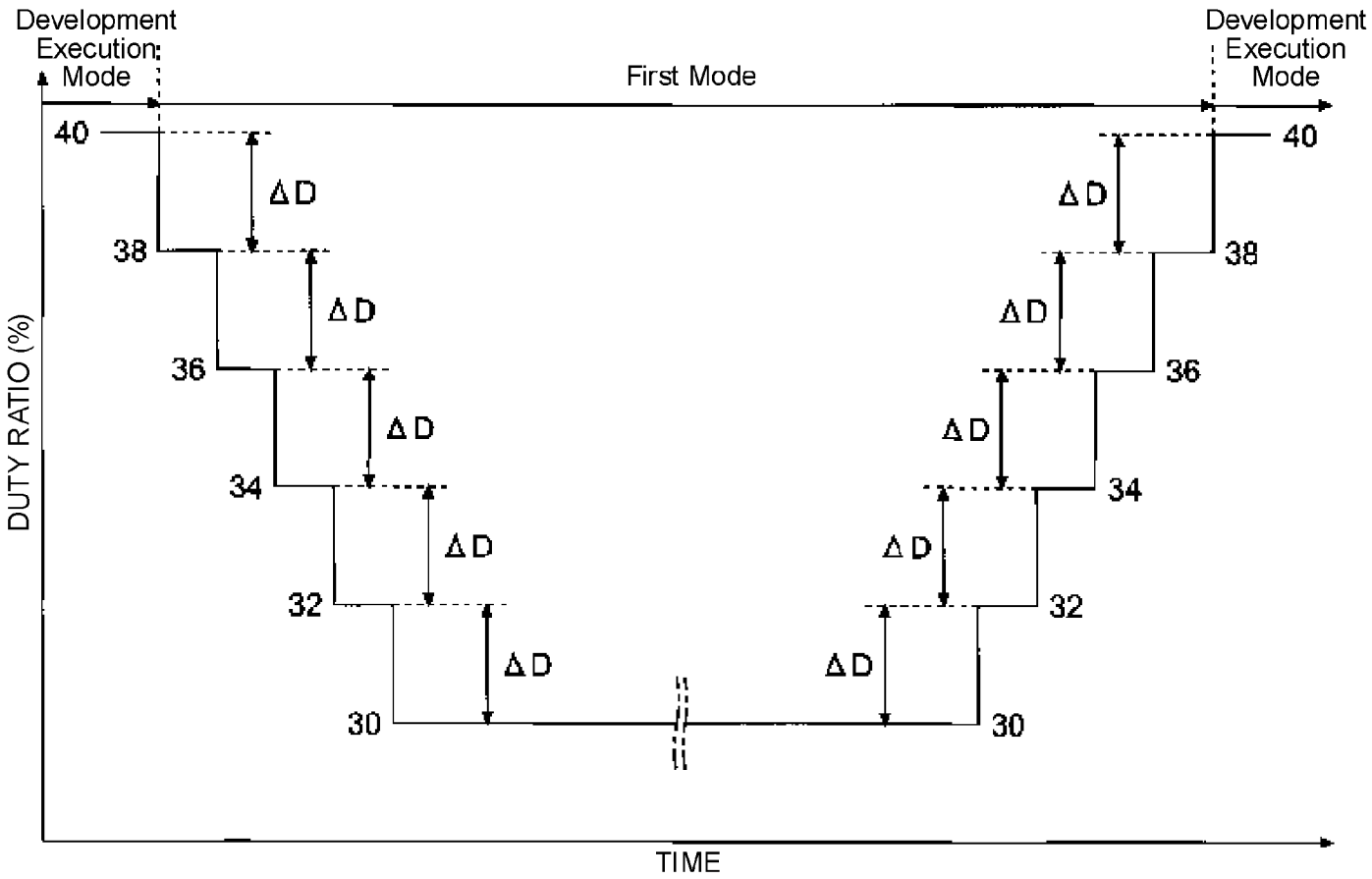
FIG. 8 is a chart for illustrating a summary of stepwise change of the duty ratio.

Stepwise change of the duty ratio in the first embodiment is next described with reference to FIG. 8. FIG. 8 is a chart for illustrating a summary of stepwise change of the duty ratio.

In this embodiment, the duty ratio is changed according to the mode. For example, in the development execution mode, the signal control section 80 in the printer 100 of this embodiment sets the duty ratio of the control clock signal S1 and the duty ratio of the voltage to be applied to the developing roller 11 at about 40% (sets the duty ratio of the voltage to be applied to the capacitor 81 at about 60%). On the other hand, in the first and second modes during the sheet interval, before the start of development or after the end of development, the signal control section 80 sets the duty ratio of the control clock signal S1 and the duty ratio of the voltage to be applied to the developing roller 11 at about 30% (sets the duty ratio of the voltage to be applied to the capacitor 81 at about 70%). Although in the description of this embodiment the duty ratios in the first and second modes are the same, they may be different from each other. Furthermore, the duty ratio in each mode is not limited to the above example.

However, if in the case of using the transformer 82 (coil), the duty ratio is changed, a voltage showing asymmetry between the positive and negative sides will be applied to the transformer 82. If such an asymmetric voltage is applied to the transformer 82, the transformer 82 will produce a magnetic bias and will be thus as if a DC bias might be applied to it.

Particularly, if an AC voltage is applied to the transformer 82 producing a magnetic bias, magnetic saturation will be likely to occur. If magnetic saturation occurs, the impedance of the transformer 82 is generally only the winding resistance thereof. In this case, a large current may flow through the first transistor 831 connected through the capacitor 81 to the transformer 82 to break down the first transistor 831.

As the amount of duty ratio changed is larger, the degree of magnetic bias in the transformer 82 becomes larger. As the degree of magnetic bias is larger, magnetic saturation will be more likely to occur. For example, in the developing device 1 of this embodiment, the duty ratio in the development execution mode is 10% different from that in the first and second modes. If the duty ratio is changed 10% at once, the degree of magnetic bias will be large, which makes it highly likely that the switching section 83 (first transistor 831) breaks down.

Meanwhile, if a change in duty ratio causes the transformer 82 to produce a magnetic bias, the transformer 82 will be biased to temporarily change the potential between the capacitor 81 and the transformer 82. Then, the magnetic bias gradually vanishes with time while the potential between the capacitor 81 and the transformer 82 fluctuates owing to the resonance between the capacitor 81 and the transformer 82. Thus, the magnetic bias in the transformer 82 tends to vanish with time.

In view of this, in the developing device 1 of this embodiment, the signal control section 80 changes the duty ratio of the control clock signal S1 (the duty ratio of the voltage to be applied to the capacitor 81) stepwise to the desired duty ratio while limiting the amount of duty ratio changed in each step. Thus, the duty ratio can be changed without breakdown of the first transistor 831 due to eddy current.

A description is given of an example of a change of the duty ratio with reference to FIG. 8. The example of FIG. 8 shows an example of a change of the duty ratio when a plurality of paper sheets are successively printed and the mode transitions from the development execution mode to the first mode during the sheet interval and then to the development execution mode. In the example of FIG. 8, the duty ratio of the control clock signal S1 in the development execution mode is shown as about 40% (the duty ratio of the voltage to be applied to the capacitor 81 is about 60%) and the duty ratio of the control clock signal S1 in the first mode is shows as about 30% (the duty ratio of the voltage to be applied to the capacitor 81 is about 70%).

As shown in FIG. 8, in changing the duty ratio of the control clock signal S1 from that in the development execution mode to that in the first mode, the signal control section 80 (control signal generating section 802) changes the duty ratio in equal step sizes that may cause no magnetic saturation in the transformer 82 (an example of the step size is shown as AD in FIG. 8). Also in changing the duty ratio of the control clock signal S1 from that in the first mode back to that in the development execution mode, the signal control section 80 changes the duty ratio in equal step sizes that may cause no magnetic saturation in the transformer 82 (an example of the step size is shown as AD in FIG. 8). For example, the step size is 2% in the example of FIG. 8. The step size can be arbitrarily set at such a value that may cause no magnetic saturation in the transformer 82, such as by performing experiments in advance.

In the case where, as shown in FIG. 8, the width of the duty ratio of the control clock signal S1 to be changed is 10% and the step size is 2%, the signal control section 80 changes the duty ratio in five steps (in five changes). The number of steps may be six or more, or may be two to four. However, because a larger number of steps are less likely to cause magnetic saturation in the transformer 82, the number of steps is preferably five or more, for example.

(Timing to Change Duty Ratio)

Figure 9:
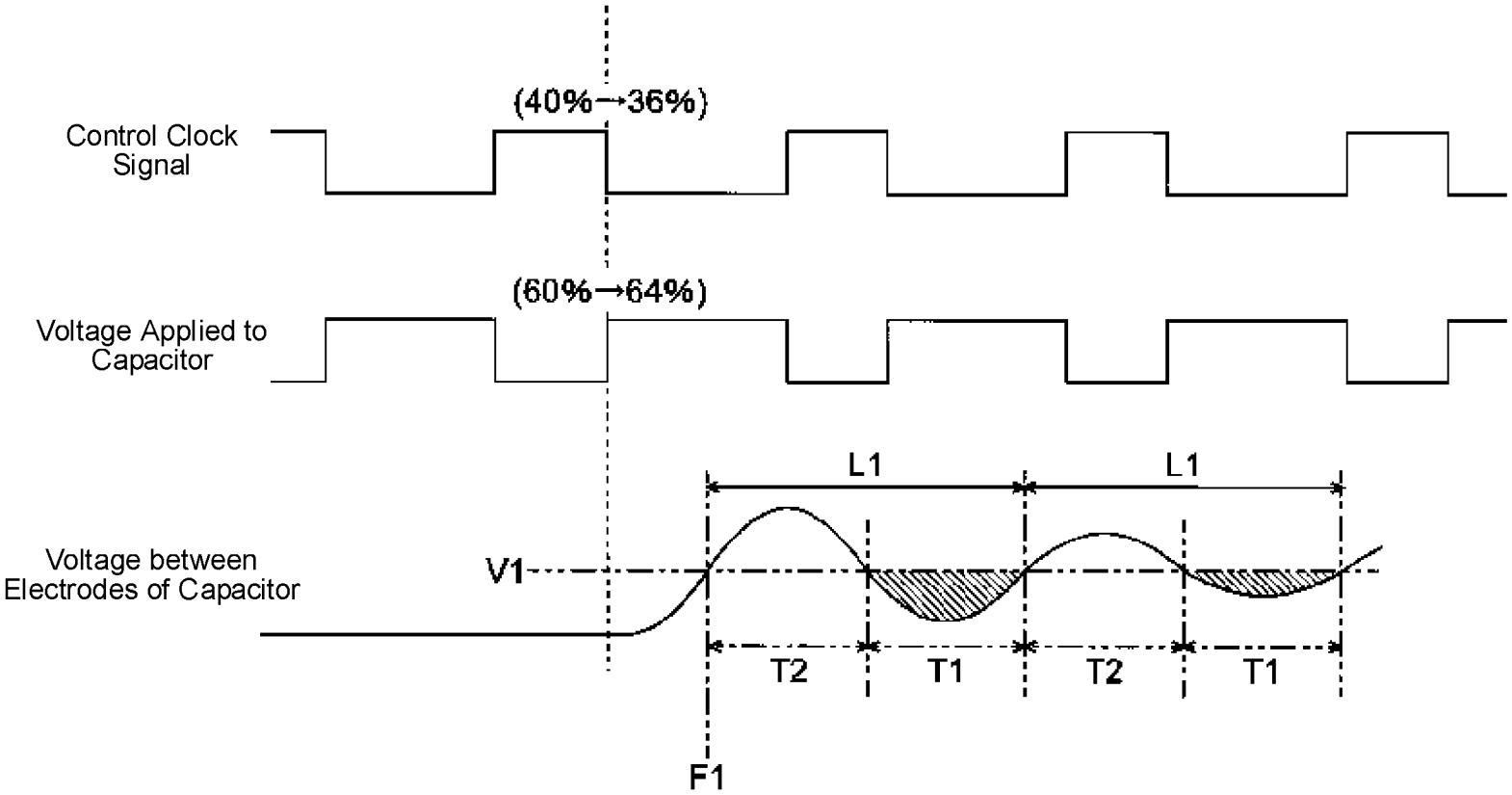
FIG. 9 is a diagram for illustrating a changing time slot in which the duty ratio is to be changed.
Figure 10:
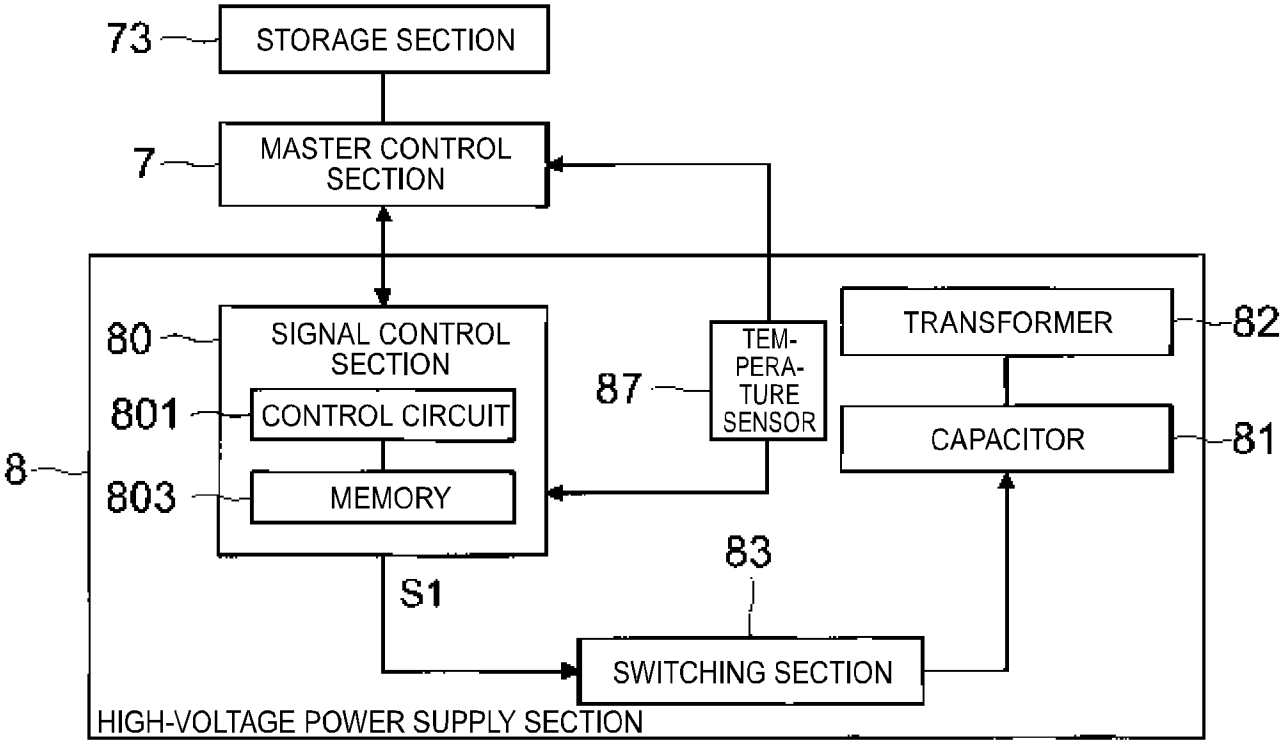
FIG. 10 is a block diagram showing an example of a configuration for detecting the surrounding temperature around a capacitor and a transformer.

A description is next given of a time slot in which the duty ratio is to be changed with reference to FIGS. 9 to 12. FIG. 9 is a diagram for illustrating a changing time slot T2 in which the duty ratio is to be changed. FIG. 10 is a block diagram showing an example of a configuration for detecting the surrounding temperature around the capacitor 81 and the transformer 82. FIG. 11 is a table for illustrating an example of a set of pieces of temperature characteristic data for determining the resonance period. FIG. 12 is a table for illustrating another example of the set of pieces of temperature characteristic data for determining the resonance period.

As described previously, in this embodiment, the duty ratio of the control clock signal S1 is changed stepwise to change the duty ratio of the voltage to be applied to the capacitor 81 and the waveform of voltage to be applied to the developing roller 11. Magnetic saturation becomes less likely to occur in the transformer 82 with the passage of time since a change of the duty ratio. However, because the duty ratio is changed during the sheet interval (between the development of one sheet and the development of the next sheet), the desired duty ratio should preferably be promptly reached.

It is known from experience that there is a time slot (hereinafter referred to as a "first time slot T1") in which a large current flows through the first transistor 831 when the duty ratio is changed to the next step (the second or later step) during the fluctuation in voltage between the electrodes of the capacitor 81 (during the persistence of resonance) due to the previous change of the duty ratio. The large current may break down the first transistor 831. Therefore, in changing the duty ratio stepwise, the desired duty ratio should be promptly reached while it is prevented that a large current flows through the first transistor 831.

The first time slot T1 is described with reference to FIG. 9. The chart shown in the top panel of FIG. 9 is a chart showing the waveform of the control clock signal S1 (the voltage to be applied to the developing roller 11). In FIG. 9, the duty ratio of the control clock signal S1 is changed from about 40% to about 36% at the point of time indicated by the broken line (an example of transition from the development execution mode to the first mode).

The chart shown in the second panel of FIG. 9 shows the waveform of the voltage to be applied to the capacitor 81 (the voltage between the electrodes of the capacitor 81). In FIG. 9, the duty ratio of the voltage to be applied to the capacitor 81 is changed from about 60% to about 64% at the point of time indicated by the broken line (an example of transition from the development execution mode to the first mode).

By such a change of the duty ratio, fluctuation occurs in the voltage between the electrodes of the capacitor 81 (the amount of electric charge stored in the capacitor 81). For example, as shown in FIG. 9, when the duty ratio of the control clock signal S1 is decreased (the duty ratio of the voltage to be applied to the capacitor 81 is increased), the voltage between the electrodes of the capacitor 81 tends to rise.

The chart shown in the bottom panel of FIG. 9 shows an example of fluctuation of the voltage value between the electrodes of the capacitor 81. When the duty ratio is changed, the capacitor 81 and the primary coil 821 of the transformer 82 resonate with each other, so that the voltage between the electrodes of the capacitor 81 oscillates with a predetermined period L1. Then, the amplitude gradually decreases and then converges to the median value V1 of the fluctuation range (amplitude) in the period L1. In FIG. 9, the period of fluctuation is represented by L1.

The voltage fluctuation between the electrodes of the capacitor 81 is associated with energy oscillation between the capacitor 81 and the transformer 82 (primary coil). The inventor have found and confirmed, such as from experiments, that the period L1 of voltage fluctuation between the electrodes of the capacitor 81 is associated with (the same as or substantially equal to) the period of resonance of the series circuit 86 (i.e., between the capacitor 81 and the transformer 82).

Experiments of the inventors empirically showed that if the duty ratio was changed in valleys (shown by shaded areas in FIG. 9) of fluctuation (oscillation) of the voltage value between the electrodes of the capacitor 81, a large current was likely to flow through the first transistor 831. In other words, it is known that if the duty ratio is changed in the second half of the period L1 of voltage fluctuation between the electrodes of the capacitor 81, which is a time slot (the first time slot T1) during which the voltage value between the electrodes of the capacitor 81 is smaller than the median value V1 of the fluctuation (amplitude), a large current flows through the first transistor 831. In still other words, it is known that if the duty ratio is changed in the first half (a changing time slot T2) of the period L1 of voltage fluctuation between the electrodes of the capacitor 81, no large current flows through the first transistor 831.

Note that various factors, such as the internal circuit configuration of the high-voltage power supply section 8 or the waveform of the control clock signal S1, may cause a large current to flow through the first transistor 831 not in the second half but in the first half of the period L1 of voltage fluctuation between the electrodes of the capacitor 81. In this case, the second half of the period L1 of voltage fluctuation between the electrodes of the capacitor 81 is the changing time slot T2 in which the duty ratio should be changed to the next step, whereas the first half thereof is the first time slot T1.

There is still not a clear understanding of the mechanism by which and the reasons why a large current flows through the first transistor 831 when the duty ratio is changed during the first time slot T1. From the viewpoint of energy oscillation between the capacitor 81 and the transformer 82, a state of the capacitor 81 being at a small voltage is a state that energy may move to the transformer 82 to result in a large magnetic bias. A possible reason why a large current flows through the first transistor 831 in the above case is that a further change of the duty ratio in such a state generates a factor for a rise (change) in the voltage of the capacitor 81 to result in further production of magnetic bias and charge and discharge of the capacitor 81 and, additionally, the application of a clock facilitates the occurrence of magnetic saturation.

To cope with this, in this embodiment, in changing the duty ratio to the next step after the previous change of the duty ratio, the signal control section 80 changes the duty ratio of the control clock signal S1 during the changing time slot T2 of the period L1, away from the first time slot T1 in which a large current may flow through the first transistor 831.

A description is now given of how to determine the period L1 of voltage fluctuation between the electrodes of the capacitor 81 upon change of the duty ratio with reference to FIGS. 10 to 12. First, voltage fluctuation between the electrodes of the capacitor 81 is due to a resonance phenomenon. The resonance period can be calculated using $2\pi\sqrt{LC}$ [s] (where L represents an inductance value [H], and C represents a capacitance [F]). Therefore, the resonance frequency and resonance period can be calculated using the capacitance of the capacitor 81 and the inductance value of the transformer 82. For example, if L=1.5 mH and C=150 g, the resonance period is approximately 3 ms.

However, the characteristics of the capacitor 81 and the transformer 82 change with temperature. Depending upon the type and characteristics of parts used, the capacitance of a capacitor, for example, often increases with rising temperature. Furthermore, the capacitance does not always change in proportion with temperature. Moreover, the degree of increase or decrease in inductance value with a rise in temperature varies with the type of the transformer.

Specifically, when a development operation is performed, a current flows through the capacitor 81 and the transformer 82, so that the high-voltage power supply section 8 produces heat. Even specifically, as the number of paper sheets printed increases, the capacitor 81 and the transformer 82 reach higher temperatures. For example, the temperatures of the capacitor 81 and the transformer 82 change within the range from room temperature to about 90° C. Furthermore, the room temperature and the internal temperature of the multifunction peripheral vary depending upon the state and installation environment of the multifunction peripheral and are not necessarily kept constant at any time.

Since the temperatures of the capacitor 81 and the transformer 82 vary as above, the period L1 of voltage fluctuation between the electrodes of the capacitor 81 (resonance period) changes at any time. Therefore, if, based on the capacitance of the capacitor 81 and the inductance value of the transformer 82 at a fixed temperature (for example, a room temperature of about 25° C.), the time slot in which the duty ratio is to be changed is determined with reference to a fixedly defined period regardless of the temperature and the duty ratio is changed to the next step during the time slot, a large current may flow through the first transistor 831 and the like.

To avoid this, as shown in FIG. 10, the high-voltage power supply section 8 of the developing device 1 of this embodiment is internally provided with a temperature sensor 87 (corresponding to a temperature detecting section) configured to detect the surrounding temperature around the capacitor 81 and the transformer 82. For example, the temperature sensor 87 includes a thermistor in which the output value changes depending upon the temperature.

The output of the temperature sensor 87 is input to the signal control section 80 and the signal control section 80 recognizes the surrounding temperature of the capacitor 81 and the transformer 82. In this case, the signal control section 80 recognizes the surrounding temperature from reference to, for example, pieces of data which are stored in the memory 803 and in which output values of the temperature sensor 87 are associated with temperatures. The memory 803 also stores pieces of data about starting points F1 (see FIG. 9) of the period L1, each piece of data showing which point of time after a change of the duty ratio is the starting point F1 of the period L1.

Then, based on the recognized temperature and pieces of temperature characteristic data stored in the memory 803, the signal control section 80 determines the period L1 of voltage fluctuation between the electrodes of the capacitor 81 (the resonance period of the series circuit 86). As shown in FIG. 11, the pieces of temperature characteristic data are, for example, a tabular data set in which capacitances of the capacitor 81 and inductance values of the transformer 82 are assigned to different temperatures detected (recognized) with the temperature sensor 87. The signal control section 80 derives, from reference to the pieces of temperature characteristic data, the capacitance and inductance value associated with the detected temperature and calculates the resonance period (period L1) using the formula shown in FIG. 11.

Then, the signal control section 80 starts timing measurement using as the starting point of the period L1 the predetermined point F1 (see FIG. 9) since the start of a change of the duty ratio and changes the duty ratio of the control clock signal S1 to the next step during the changing time slot T2 (the first half of the period L1).

If in this case the half of the calculated resonance period (the period L1 of voltage fluctuation between the electrodes of the capacitor 81) is longer than a predetermined reference time, the signal control section 80 changes the duty ratio to the next step during the first changing time slot T2 after the previous change of the duty ratio. Thus, the duty ratio can be promptly changed. On the other hand, if the half of the calculated resonance period (the period L1 of voltage fluctuation between the electrodes of the capacitor 81) is not longer than the predetermined reference time, the signal control section 80 changes the duty ratio to the next step during the second changing time slot T2 after the previous change of the duty ratio. Thus, it can be prevented that a large current flows through the developing device 1, including the first transistor 831, to break down the circuit.

Therefore, the "reference time" can be determined from the viewpoint of the minimum time to be secured after a change of the duty ratio in order to prevent occurrence of magnetic saturation in the transformer 82. Furthermore, since the duty ratio is changed stepwise, the reference time is determined so that the duty ratio is changed to the next step one period of the control clock signal S1 or longer after the previous change of the duty ratio. The reference time may be changed depending upon anyone of (a) the temperature of the capacitor 81, (b) the temperature of the transformer 82, (c) the temperatures of the capacitor 81 and the transformer 82, and (d) the surrounding temperature around the capacitor 81 and the transformer 82, the one having been by detected the temperature sensor 87. The signal control section 80 holds reference times predetermined in association with surrounding temperatures and controls the change of the duty ratio using the reference time associated with the surrounding temperature acquired from the temperature sensor 87 or the reference time calculated by multiplying the surrounding temperature acquired from the temperature sensor 87 by a factor. The reference time may be determined in consideration of the time required for the signal control section 80 to change the duty ratio. Thus, even if the duty ratio is changed in multiple sequential steps, it can be prevented that magnetic saturation occurs in the transformer 82.

As shown in FIG. 12, the pieces of temperature characteristic data may be, for example, a tabular data set showing results obtained by determining the resonance period L1 of the series circuit 86 (the period L1 of voltage fluctuation between the electrodes of the capacitor 81) according to the temperature detected (recognized) with the temperature sensor 87. In this case, the signal control section 80 need not calculate the resonance period (or resonance frequency) and directly determines the period L1 from reference to the set of pieces of temperature characteristic data.

The above has described an example in which the output of the temperature sensor 87 is input to the signal control section 80 and the signal control section 80 recognizes the detected temperature and determines the resonance period (the period L1). However, as shown in FIG. 10, it is possible that the output of the temperature sensor 87 is input to the master control section 7 and the master control section 7 recognizes the surrounding temperature around the capacitor 81 and the transformer 82. In this case, the master control section 7 recognizes the surrounding temperature from reference to pieces of data which are stored in the storage device 73 and in which output values of the temperature sensor 87 are associated with temperatures. Then, the master control section 7 may determine the resonance period (the period L1) based on the recognized temperature. In this case, the pieces of temperature characteristic data are stored in the storage device 73 and the master control section 7 determines the resonance period (the period L1) by reference to the memory in the storage device 73. Then, the master control section 7 may send data showing the determined resonance period (period L1) to the signal control section 80.

The above also has described an example in which the first time slot T1 and the changing time slot T2 are determined based on the magnitude of periodically varying voltage applied to the capacitor 81 or the ease of flow of current through the first transistor 831 when the duty ratio of the control clock signal S1 is decreased to decrease the duty ratio of the voltage to be applied to the developing roller 11 (increase the duty ratio of the voltage to be applied to the capacitor 81). In the developing device 1 of this embodiment, also when the duty ratio of the control clock signal S1 is increased to decrease the duty ratio of the voltage to be applied to the capacitor 81 and increase the duty ratio of the voltage to be applied to the developing roller 11, a large current tends to be likely to flow during the first time slot T1 (in the valley of the fluctuation). Therefore, in both the cases where the duty ratio of the control clock signal S1 is decreased and increased, the first time slot T1 and the changing time slot T2 are determined and the signal control section 80 changes the duty ratio to the next step during the changing time slot T1. The first time slot T1 and the changing time slot T2 may be determined in the same manner in both the cases where the duty ratio of the control clock signal S1 is increased and decreased.

(Processing Flow upon Change of Duty Ratio)

Figure 13:
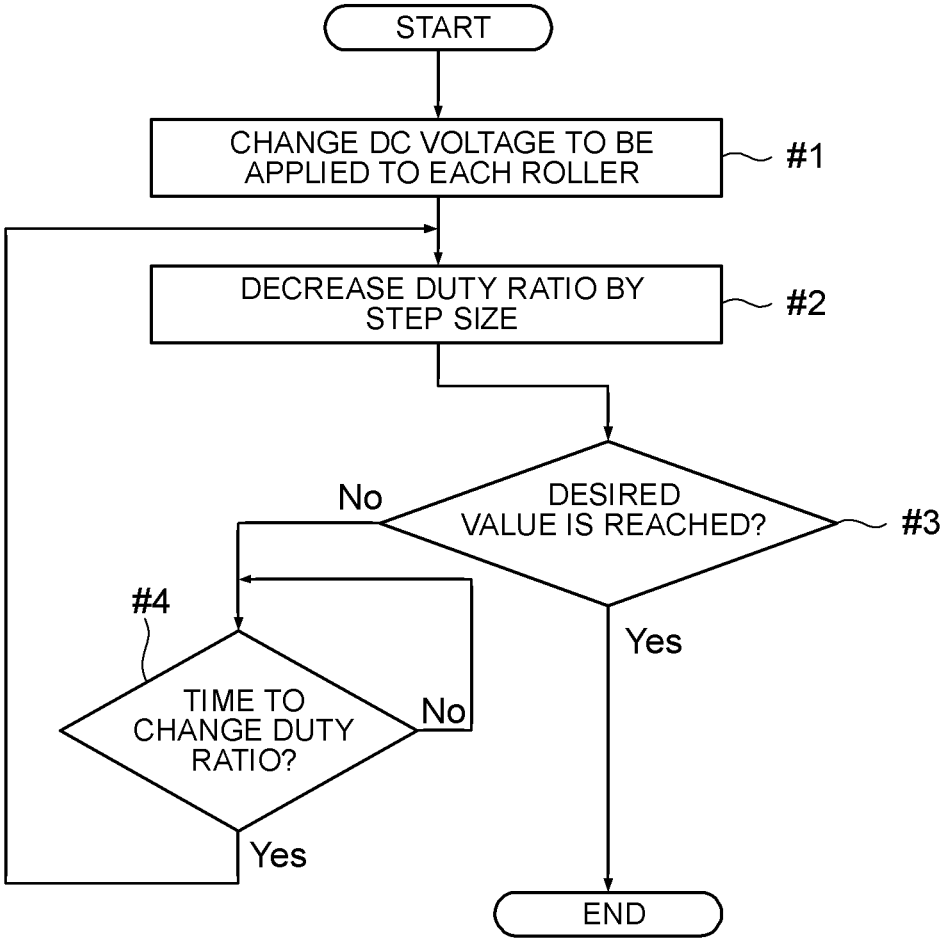

A description is next given of an example of a processing flow upon change of the duty ratio of the control clock signal S1 or the like with reference to FIG. 13. FIG. 13 is a flowchart showing the example of the processing flow upon change of the duty ratio such as of the control clock signal S1. In the developing device 1 of this embodiment, the case of change of the duty ratio corresponds to the case of transition from the development execution mode to the first or second mode, or the case of transition from the first or second mode to the development execution mode.

Therefore, the "START" in FIG. 13 is a point of time when an instruction for transition from the development execution mode to the first or second mode or an instruction for transition from the first or second mode to the development execution mode is input from the master control section 7 to the signal control section 80, the developing roller biasing section 84, and the magnetic roller biasing section 85.

Upon input of an instruction for transition from the development execution mode to the first or second mode or an instruction for transition from the first or second mode to the development execution mode, the developing roller biasing section 84 changes the DC voltage to be applied to the developing roller 11 and the magnetic roller biasing section 85 changes the DC voltage to be applied to the magnetic roller 12 (Step #1). If the biases to be applied to the developing roller 11 and the magnetic roller 12 are not changed, Step #1 is not necessary.

Subsequently, the signal control section 80 changes the duty ratio of the control clock signal S1 by a predetermined step size AD (Step #2). In the transition from the development execution mode to the first or second mode, the duty ratio of the control clock signal S1 is decreased. On the other hand, in the transition from the first or second mode to the development execution mode, the duty ratio of the control clock signal S1 is increased. The step size of the duty ratio may be varied. As a result, the duty ratio of the voltage to be applied to the capacitor 81 and the waveform of the voltage to be applied to the developing roller 11 also vary. Then, the signal control section 80 determines whether or not the desired duty ratio is reached (Step #3).

If the desired duty ratio is reached (Yes in Step #3), the flow terminates (END). Thus, the signal control section 80 (the control signal generating section 802) performs the switching of the first transistor 831 and the second transistor 831 while keeping the duty ratio until it receives an instruction for mode transition or an instruction for no voltage application from the master control section 7. When an instruction for mode transition or an instruction to change the duty ratio is given from the master control section 7 to the signal control section 80, the flow starts again from Step #1.

On the other hand, if the desired duty ratio is not reached (No in Step #3), the signal control section 80 continues to determine whether or not the point of time to change the duty ratio by a step size is reached (Step #4, wherein if No, the flow returns to Step #4). For example, the signal control section 80 contains a timer and therefore has a timer function. The signal control section 80 determines whether or not the next point of time to change the duty ratio by a step size after the previous change of the duty ratio is reached.

Specifically, when the signal control section 80 previously has changed the duty ratio, it checks the temperature of the capacitor 81 and so on based on the output of the temperature sensor 87 and the associated piece of temperature characteristic data stored in the memory 803 or the like. Then, the signal control section 80 calculates the resonance period of the series circuit 86 (the period L1 of voltage fluctuation between the electrodes of the capacitor 81). Then, the signal control section 80 determines whether or not the changing time slot T2 of the period L1 of voltage fluctuation between the electrodes of the capacitor 81 is reached. The signal control section 80 may determine to be Yes in Step #4 when the first changing time slot T2 after the previous change of the duty ratio is reached, or determine to be Yes in Step #4 when the second or later changing time slot T2 is reached. If the next point of time to change the duty ratio by a step size AD is reached (Yes in Step #4), the flow returns to Step #2.

(Second Embodiment)

Figure 14:
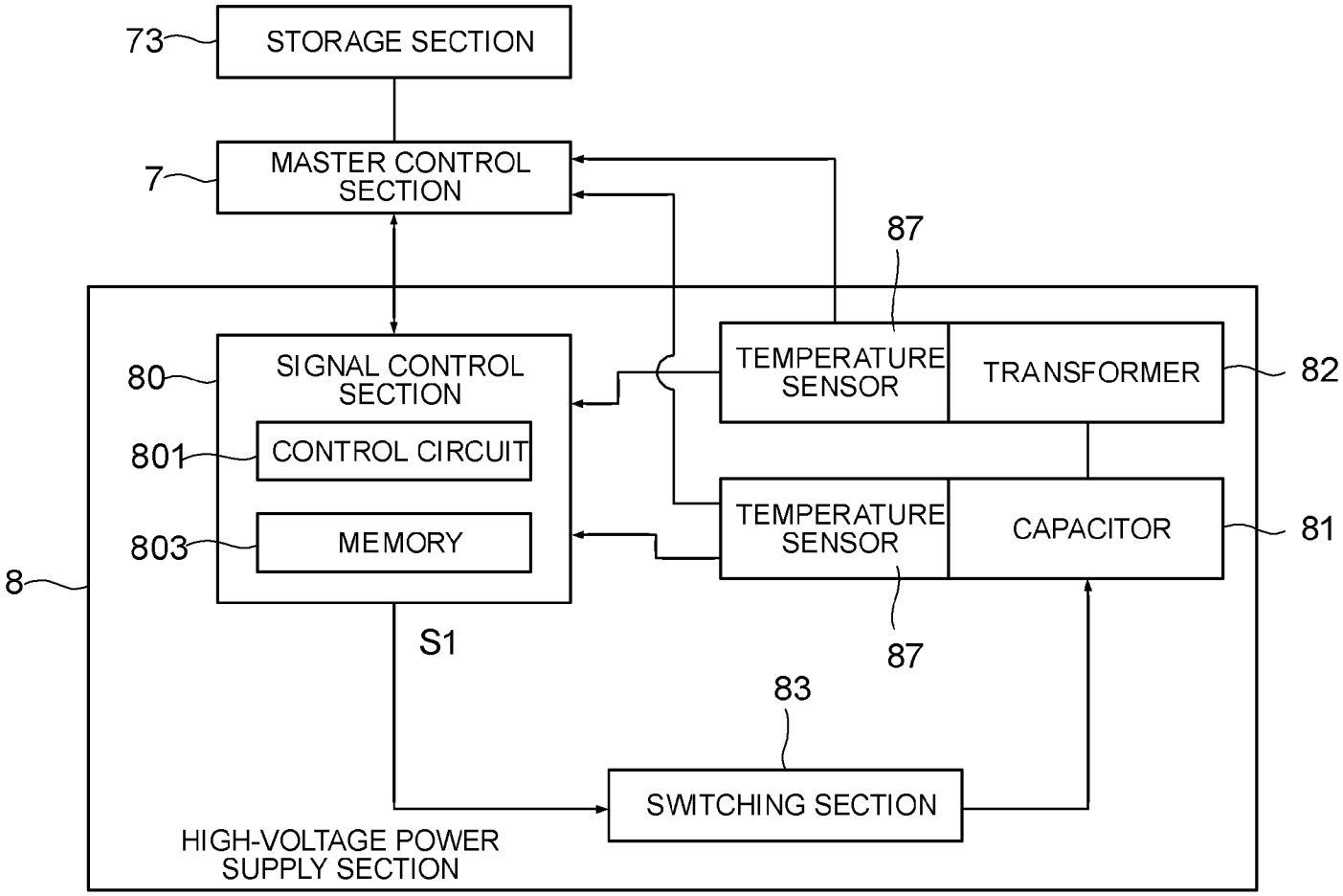
FIG. 14 is a block diagram showing an example of a configuration for detecting the respective temperatures of the capacitor and the transformer.

Next, a second embodiment is described with reference to FIGS. 14 and 15. FIG. 14 is a block diagram showing an example of a configuration for detecting the respective temperatures of the capacitor 81 and the transformer 82. FIG. 15 is a table for illustrating still another example of a set of pieces of temperature characteristic data for determining the resonance period.

The second embodiment is different from the first embodiment in that the respective temperatures of the capacitor 81 and the transformer 82 are detected and the resonance period L1 of the series circuit 86 (the period L1 of voltage fluctuation between the electrodes of the capacitor 81) is determined based on the detected temperatures of the capacitor 81 and the transformer 82. The rest is the same as that in the first embodiment. Therefore, as for the intersection between both the embodiments, the description of the first embodiment is incorporated in that of the second embodiment and the description and graphic illustration of the intersection are not given here.

First, like the first embodiment, the high-voltage power supply section 8 of the developing device 1 of this embodiment is internally provided with temperature sensors 87 configured to detect the surrounding temperatures around the capacitor 81 and the transformer 82. For example, each temperature sensor 87 includes a thermistor in which the output value changes depending upon the temperature. However, unlike the first embodiment, the temperature sensors 87 are provided, one for each of the capacitor 81 and the transformer 82 as shown in FIG. 14. The temperature sensor 87 for the capacitor 81 is in contact with the capacitor 81 to accurately detect the temperature of the capacitor 81. The temperature sensor 87 for the transformer 82 is also in contact with the transformer 82 to accurately detect the temperature of the transformer 82. However, each temperature sensor 87 may be out of contact with the capacitor 81 or transformer 82.

The outputs of the temperature sensors 87 are input to the signal control section 80 and the signal control section 80 recognizes the respective temperatures of the capacitor 81 and the transformer 82. In this case, the signal control section 80 recognizes the respective temperatures of the capacitor 81 and the transformer 82 from reference to, for example, pieces of data which are stored in the memory 803 and in which output values of the temperature sensors 87 are associated with temperatures.

Then, based on the recognized temperatures and pieces of temperature characteristic data stored in the memory 803, the signal control section 80 determines the period L1 of voltage fluctuation between the electrodes of the capacitor 81 (the resonance period of the series circuit 86). As shown in FIG. 15, the pieces of temperature characteristic data are, for example, a tabular data set in which capacitances of the capacitor 81 are assigned to different detected (recognized) temperatures of the capacitor 81 and inductance values of the transformer 82 are assigned to different detected (recognized) temperatures of the transformer 82. The signal control section 80 derives, from reference to the pieces of temperature characteristic data, the capacitance and inductance value associated with the detected temperatures and calculates the period L1 using the formula shown in FIG. 15.

Then, the signal control section 80 starts timing measurement using as the starting point of the period L1 the predetermined point F1 (see FIG. 9) since the start of a change of the duty ratio and changes the duty ratio of the control clock signal S1 to the next step during the changing time slot T2 (the first half of the period L1 in this embodiment), like the first embodiment.

If in this case the half of the calculated resonance period (the period L1 of voltage fluctuation between the electrodes of the capacitor 81) is longer than a predetermined reference time, the signal control section 80 changes the duty ratio to the next step during the first changing time slot T2 after the previous change of the duty ratio. The reason for this is that even if the duty ratio is changed during the first changing time slot T2, a time enough to prevent occurrence of magnetic saturation in the transformer 82 can be secured. Thus, the duty ratio can be promptly changed.

On the other hand, if the half of the calculated resonance period (the period L1 of voltage fluctuation between the electrodes of the capacitor 81) is not longer than the predetermined reference time, the signal control section 80 changes the duty ratio to the next step during the second changing time slot T2 after the previous change of the duty ratio. This is to secure a time enough to prevent occurrence of magnetic saturation in the transformer 82. Thus, it can be prevented that a large current flows through the developing device 1, including the first transistor 831, to break down the circuit.

The above has described an example in which the outputs of the temperature sensors 87 are input to the signal control section 80 and the signal control section 80 recognizes the detected temperatures and determines the resonance period (the period L1). However, as shown in FIG. 14, it is possible that the outputs of the temperature sensors 87 are input to the master control section 7 and the master control section 7 recognizes the respective temperatures of the capacitor 81 and the transformer 82. The master control section 7 recognizes the respective temperatures of the capacitor 81 and the transformer 82 from reference to, for example, pieces of data which are stored in the storage device 73 and in which output values of the temperature sensors 87 are associated with temperatures.

Then, the master control section 7 may determine the resonance period L1. In this case, the pieces of temperature characteristic data are stored in the storage device 73 and the master control section 7 determines the period L1 by reference to the memory in the storage device 73. Then, the master control section 7 may send data showing the determined period L1 to the signal control section 80.

It is known from experience that when the duty ratio of a signal input to the series circuit 86 including the capacitor 81 and the transformer 82 (coil) is changed, resonance occurs, so that the voltage between the electrodes of the capacitor 81 fluctuates with the same period as the resonance period. Since the capacitance of the capacitor 81 and the inductance value of the transformer 82 change with temperature, the resonance period (resonance frequency) also changes with temperature. Thus, when a voltage is applied to (a current is passed through) the capacitor 81 and the transformer 82 for the purpose of development, the temperatures of the capacitor 81 and the transformer 82 rise. Therefore, the resonance period changes depending upon the state of use (temperature condition) of the developing device 1. Hence, the time slot in which a large current flows through the developing device 1 upon change of the duty ratio changes depending upon the temperatures of the capacitor 81 and the transformer 82.

To cope with this, the developing device 1 of each of the first and second embodiments includes a developing roller 11, a magnetic roller 12, a capacitor 81, a transformer 2, a switching section 83, a signal control section 80, a single or a plurality of temperature detecting sections, and a storage section. The developing roller 11 is disposed to face the associated photosensitive drum 42 and configured to carry toner thereon. The magnetic roller 12 is disposed to face the developing roller 11 and configured to, using a magnetic brush technique, supply the toner to the developing roller 11 and detach the toner from the developing roller 11. The transformer 82 is connected on the primary side to the capacitor 81 and configured to output from the secondary side an AC voltage to be applied to the developing roller 11. The switching section 83 is connected to the capacitor 81 and includes the switching elements (such as the first transistor 831) capable of switching between energization and de-energization of the series circuit 86 including the capacitor 81 and the transformer 82. The signal control section 80 is configured to generate a control signal (control clock signal S1) for controlling the switching of the switching section 83 and control the duty ratio of the control signal. The temperature detecting section is configured to detect the surrounding temperature around the capacitor 81 and the transformer 82 or the respective temperatures of the capacitor 81 and the transformer 82. In these embodiments, the temperature detecting section is the temperature sensor 87. A single temperature sensor 87 is provided in the first embodiment, while temperature sensors 87 are provided one for each of the capacitor 81 and the transformer 82 in the second embodiment. The storage section is the memory 803 or the storage device 73 and stores, in association with temperatures detected by the temperature detecting section or sections, pieces of temperature characteristic data for determining the resonance period of the series circuit 86. When changing the duty ratio of the control signal in multiple sequential steps, the signal control section 80 determines the resonance period of the series circuit 86 based on the temperature detected with the temperature detecting section and the piece of temperature characteristic data associated with the detected temperature and changes the duty ratio of the control signal (control clock signal S1) to the next step during the changing time slot T2 which is one of the first and second halves of the period L1 of voltage fluctuation of the capacitor 81 based on the determined resonance period, the one half in which the current flowing through the switching section 83 is smaller than in the other half of the period.

Thus, even if the voltage between the electrodes of the capacitor 81 is periodically oscillating as a result of a change of the duty ratio, the duty ratio can be changed to the next step during a time slot in which a large current is less likely to flow through the switching element (such as the first transistor 831), with consideration to the temperatures of the capacitor 81 and the transformer 82. Therefore, regardless of the state and temperature of the developing device 1 and without breakdown of the switching element, the duty ratio of the control signal (control clock signal S1) can be safely changed to the desired duty ratio.

Furthermore, when the half of the determined resonance period is longer than the predetermined reference time, the signal control section 80 changes the duty ratio of the control signal (control clock signal S1) to the next step during the first changing time slot T2 after the previous change of the duty ratio. On the other hand, when the half of the determined resonance period is not longer than the predetermined reference time, the signal control section 80 changes the duty ratio of the control signal to the next step during the second changing time slot T2 after the previous change of the duty ratio. Thus, when the time slot (changing time slot T2) to change the duty ratio is relatively long (the half of the determined resonance period is longer than the predetermined reference time), the duty ratio is promptly changed again during the first changing time slot T2. Therefore, the time required to reach the desired duty ratio can be shortened. On the other hand, when the time slot (changing time slot T2) to change the duty ratio is relatively short (the half of the determined resonance period is not longer than the predetermined reference time), the duty ratio is promptly changed again during the second changing time slot T2. Thus, when the time taken from the previous change of the duty ratio to the next change thereof is short, the change of duty ratio to the next step can be made in a safe time slot in which any large current due to magnetic saturation does not flow.

The storage section (the memory 803 or the storage device 73) stores, as the pieces of temperature characteristic data, pieces of data in which capacitances of the capacitor 81 and inductance values of the transformer 82 are assigned to different temperatures detected with the temperature detecting section (temperature sensor 87). By reference to the pieces of temperature characteristic data stored in the storage section, the signal control section 80 derives the capacitance of the capacitor 81 and the inductance value of the transformer 82 at the detected temperature. The signal control section 80 determines the resonance period of the series circuit 86 by calculation using the derived capacitance and inductance value. Thus, the resonance period depending upon the temperatures of the capacitor 81 and the transformer 82 constantly changing together with the execution of development can be determined by calculation.

Alternatively, the storage section (the memory 803 or the storage device 73) stores, as the pieces of temperature characteristic data, pieces of data in which various resonance periods of the series circuit 86 are assigned to different temperatures detected with the temperature detecting section (temperature sensor 87). The signal control section 80 determines the resonance period of the series circuit 86 from reference to the pieces of temperature characteristic data stored in the storage section (the memory 803 or the storage device 73). Thus, the resonance period can be determined directly from the pieces of temperature characteristic data.

It is known from experience that if, in a state of energy oscillation between the capacitor 81 and the primary coil of the transformer 82, the duty ratio is changed as the voltage between the electrodes of the capacitor 81 is small, a large current flows through the switching element (such as the first transistor 831). Although the mechanism is not completely figured out, it can be considered as follows. Generally, when a current starts to flow through the coil connected to the capacitor 81 storing electric power, the voltage applied to the capacitor 81 gradually drops (energy gradually moves to the coil). If the duty ratio is changed with the electric power from the capacitor 81 flowing through the coil (the primary side of the transformer 82) as described above, the voltage between the electrodes of the capacitor 81 may further rise. This further rise in voltage between the electrodes of the capacitor 81 may be one of factors that cause a large current to flow through the switching section 83. To cope with this, the changing time slot T2 is set to a time slot in which the voltage between the electrodes of the capacitor 81 is larger than the median value V1 of the range of voltage fluctuation. Thus, the duty ratio can be changed during a time slot known from experience to be one in which a large current is less likely to flow through the switching element. Therefore, without breakdown of the switching element, the duty ratio can be safely and promptly changed to a desired value.

If the duty ratio of the control signal (the control clock signal S1, the voltage to be applied to the capacitor 81) differs between during printing and out of printing, unevenness of the toner image may be appropriately eliminated to make the leakage between the developing roller 11 and the photosensitive drum 42 less likely to occur. Therefore, the signal control section 80 makes the duty ratio of the control signal (control clock signal S1) in the development execution mode where an electrostatic latent image formed on the photosensitive drum 42 is developed different from the duty ratio of the control signal (control clock signal S1) in the development unexecution mode where an electrostatic latent image formed on the photosensitive drum 42 is not yet developed. The duty ratio in the development execution mode is greater than that in the development unexecution mode. Therefore, upon transition from the development execution mode to the development unexecution mode, the switching section 83 decreases the duty ratio stepwise multiple times from the duty ratio in the development execution mode to the duty ratio in the development unexecution mode. On the other hand, upon transition from the development unexecution mode to the development execution mode, the switching section 83 increases the duty ratio stepwise multiple times from the duty ratio in the development unexecution mode to the duty ratio in the development execution mode. Thus, leakage can be less likely to occur while unevenness of the toner image is appropriately eliminated.

The image forming apparatus (for example, the printer 100) includes the above developing device 1. Specifically, the image forming apparatus (for example, the printer 100) includes the developing device 1 that even if the duty ratio is changed, no large current flows and the duty ratio can be safely changed to a desired value. Therefore, an image forming apparatus can be provided which is free of failure in the developing device 1, can smoothly change the duty ratio from that during the development of a toner image to that out of development and vice versa, is free of unevenness of the toner image to provide a high image quality, and presents no problem due to leakage.

Although the above embodiments have described positively charged photosensitive drum 42 and toner as an example, the present disclosure can also be applied to the case of using negatively charged photosensitive drum 42 and toner. In this case, the duty ratio may be set to reduce unevenness of a toner image in a state where development is performed for negative charge (in a development execution mode), while it may be set to avoid occurrence of leakage in a state where development is not yet performed (in a development unexecution mode).

Although the embodiments of the present disclosure have been heretofore described, the scope of the invention is not limited to the above embodiments and can be implemented by variously changing the invention without departing from the spirit of the invention.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A developing device including:

a developing roller facing a photosensitive drum and configured to carry toner thereon;

a magnetic roller facing the developing roller and configured to, using a magnetic brush technique, supply the toner to the developing roller and detach the toner from the developing roller;

a capacitor;

a transformer connected on a primary side thereof to the capacitor and configured to output from a secondary side thereof an AC voltage to be applied to the developing roller;

a switching section connected to the capacitor and including a switching element capable of switching between energization and de-energization of a series circuit, the series circuit including the capacitor and the transformer;

a control section configured to generate a control signal for controlling the switching of the switching section and control the duty ratio of the control signal;

a single or a plurality of temperature detecting sections configured to detect the surrounding temperature around the capacitor and the transformer or the respective temperatures of the capacitor and the transformer; and a storage section storing, in association with temperatures detected by the temperature detecting section or sections, pieces of temperature characteristic data for determining the resonance period of the series circuit, wherein the control section changes the duty ratio of the control signal in multiple sequential steps to a desired duty ratio, and when changing the duty ratio in the multiple sequential steps, the control section determines the resonance period of the series circuit based on the temperature detected with the temperature detecting section and the piece of temperature characteristic data associated with the detected temperature and changes the duty ratio of the control signal to the next step during a changing time slot which is one of the first and second halves of a period of voltage fluctuation of the capacitor based on the determined resonance period, the one half in which the current flowing through the switching section is smaller than in the other half of the period.

2. The developing device according to claim 1, wherein when changing the duty ratio of the control signal in the multiple sequential steps, the control section changes the duty ratio in predetermined step sizes in which no magnetic saturation occurs in the transformer.

3. The developing device according to claim 1, wherein when the half of the determined resonance period is longer than a predetermined reference time, the control section changes the duty ratio of the control signal to the next step during a first changing time slot after the previous change of the duty ratio, and when the half of the determined resonance period is not longer than the predetermined reference time, the control section changes the duty ratio of the control signal to the next step during a second changing time slot after the previous change of the duty ratio.

4. The developing device according to claim 3, wherein the predetermined reference time is determined according to a time to be secured to avoid occurrence of magnetic saturation in the transformer after the previous change of the duty ratio.

5. The developing device according to claim 3, wherein the predetermined reference time is a time during which the duty ratio is to be changed to the next step one period of the control clock signal or longer after the previous change of the duty ratio.

6. The developing device according to claim 3, wherein the control section changes the reference time depending upon anyone of the temperature of the capacitor, the temperature of the transformer, the temperatures of the capacitor and the transformer, and the surrounding temperature around the capacitor and the transformer, the one having been detected by the temperature detecting section.

7. The developing device according to claim 1, wherein the storage section stores, as the pieces of temperature characteristic data, pieces of data in which capacitances of the capacitor and inductance values of the transformer are assigned to different temperatures detected with the temperature detecting section, and the control section derives the capacitance of the capacitor and the inductance value of the transformer at the detected temperature from reference to the pieces of temperature characteristic data stored in the storage section and determines the resonance period of the series circuit by calculation using the derived capacitance and inductance value.

8. The developing device according to claim 1, wherein the storage section stores, as the pieces of temperature characteristic data, pieces of data in which various resonance periods of the series circuit are assigned to different temperatures detected with the temperature detecting section, and the control section determines the resonance period of the series circuit from reference to the pieces of temperature characteristic data stored in the storage section.

9. The developing device according to claim 1, wherein the changing time slot is a time slot in which the voltage between the electrodes of the capacitor is larger than the median value of the range of voltage fluctuation.

10. The developing device according to claim 1, wherein the control section makes the duty ratio of the control signal in a development execution mode where an electrostatic latent image formed on the photosensitive drum is developed different from the duty ratio of the control signal in a development unexecution mode where an electrostatic latent image formed on the photosensitive drum is not yet developed, the duty ratio in the development execution mode is greater than that in the development unexecution mode, upon transition from the development execution mode to the development unexecution mode the switching section decreases the duty ratio stepwise multiple times from the duty ratio in the development execution mode to the duty ratio in the development unexecution mode, and upon transition from the development unexecution mode to the development execution mode, the switching section increases the duty ratio stepwise multiple times from the duty ratio in the development unexecution mode to the duty ratio in the development execution mode.

11. An image forming apparatus including the developing device according to claim 1.

12. A method for changing the duty ratio of a voltage to be applied to a developing roller by controlling switching of a switching section between energization and de-energization of a series circuit including a capacitor and a transformer configured to output from a secondary side thereof an AC voltage to be applied to the developing roller, the method including:

a temperature detecting step of detecting the surrounding temperature around the capacitor and the transformer or the respective temperatures of the capacitor and the transformer;

a temperature characteristic data acquiring step of acquiring a piece of temperature characteristic data associated with the temperature detected in the temperature detecting step from a storage section storing pieces of temperature characteristic data for determining the resonance period of the series circuit;

a resonance period acquiring step of determining the resonance period of the series circuit based on the piece of temperature characteristic data acquired in the temperature characteristic data acquiring step;

a changing time slot detecting step of detecting a changing time slot which is one of the first and second halves of a period of voltage fluctuation of the capacitor based on the resonance period acquired in the resonance period acquiring step, the one half in which the current flowing through the switching section is smaller than in the other half of the period; and a duty ratio changing step of, in changing the duty ratio of a control signal in multiple sequential steps to a desired duty ratio, the control signal for controlling the switching of the switching section, changing the duty ratio of the control signal to the next step during the changing time slot detected in the changing time slot detecting step.

* * * * *